US005996997A

United States Patent [19]

Kamille

[11] Patent Number: 5,996,997

[45] Date of Patent: Dec. 7, 1999

[54] METHOD AND APPARATUS FOR REDEEMING A GAME PIECE

[75] Inventor: Stuart J. Kamille, 636 Jefferson Cir., Atlanta, Ga. 30328

[73] Assignee: Stuart J. Kamille, Atlanta, Ga.

[21] Appl. No.: 08/858,008

[22] Filed: May 16, 1997

[51] Int. Cl.[6] ..... A63F 3/06

[52] U.S. Cl. ..... 273/139; 273/138.1; 463/29; 463/17

[58] Field of Search ..... 273/139, 138.1, 273/269; 463/17, 18, 29

[56] References Cited

U.S. PATENT DOCUMENTS

| | | | |
|---|---|---|---|
| 3,826,499 | 7/1974 | Lenkoff | 273/139 |
| 4,508,513 | 4/1985 | Donovan | 434/364 |
| 4,756,532 | 7/1988 | Kamille | 273/153 R |
| 4,964,642 | 10/1990 | Kamille | 273/240 |
| 5,046,737 | 9/1991 | Fienberg | 273/139 |
| 5,092,598 | 3/1992 | Kamille | 273/139 |
| 5,094,458 | 3/1992 | Kamille | 273/240 |
| 5,407,199 | 4/1995 | Gumina | 273/139 |
| 5,657,991 | 8/1997 | Camarato | 273/269 |

FOREIGN PATENT DOCUMENTS

| | | | |
|---|---|---|---|
| 2185413 | 7/1987 | United Kingdom | 273/139 |

*Primary Examiner*—Benjamin H. Layno
*Attorney, Agent, or Firm*—Blakely, Sokoloff, Taylor & Zafman

[57] ABSTRACT

A probability game having multiple game pieces each having areas which are covered with removable concealer and contain void and/or win areas. The game is controlled by player-made choices with respect to selecting areas to uncover on the game pieces that are potential winners.

53 Claims, 19 Drawing Sheets

RINGER
Start Anywhere on the outer ring.
Follow the arrows until you reach the center.
Double headed arrows give you a choice.
A VOID ends the game.

RINGER
Start Anywhere on the outer ring.
Follow the arrows until you reach the center.
Double headed arrows give you a choice.
A VOID ends the game.

Start at a start star. Follow the arrows. A double headed arrow means choose either direction.
ONE VOID ENDS GAME Examples of Directionals Start at a start star. Follow the arrows. A double headed arrow means choose either direction.
ONE VOID ENDS GAME

© 1997 STUART KAMILLE

METHOD AND APPARATUS FOR REDEEMING A GAME PIECE

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

FIELD OF THE INVENTION

The present invention is directed to a game; particularly, the present invention is directed to a game having game pieces (or tickets) with playing surfaces having areas that are covered with removable material and which are removed as part of the game by a player.

BACKGROUND OF THE INVENTION

Recently, lotteries have been used worldwide as a way to generate revenue for state and local governments. Typically, these lotteries use "dedicated" tickets, or game pieces. That is, the ticket is either solely a winning ticket or a losing ticket. The player removes all the material, such as latex, covering a portion of the ticket to determine if the ticket is either an instant loser or an instant winner. Since the lotteries are for profit enterprises, there are many more losing tickets than winning ones. Therefore, dedicated games are more often instant lose games than instant win games. Nevertheless, they are very popular.

Currently, dedicated game pieces rely solely on imaginative graphics, colors and themes to stimulate customer sales. A drawback to using dedicated game pieces is that they provide little variation in the play style. Without skill one need only remove the covering material to determine if the game piece is a winner or a loser. Since the style of play is so repetitive, player burnout has become an increasing problem. Recently there has been interest in other forms of game play which might rekindle customer interest.

Traditional lottery games rely on scratch off game pieces which are seeded before distribution in order to control the number of potential winners. A mix of winners to losers is prearranged by the customer. Once offered for sale to the public, the results of the lottery are predictable with an amount set aside to cover the winning game pieces. This amount is referred to as the prize purse or prize liability.

Because the number of winners is tightly controlled, the sponsor is given great psychological comfort. After all, if the number of game pieces is limited, then only that number of winners can be redeemed and no more. As a practical matter, games of this nature actually redeem at less than the maximum redemption amount since all of the game pieces are not sold, not played correctly, or invalidated in some manner.

There is another way to control the number of prizes awarded which uses the laws of probability. Such a game is commonly referred to as a probability game. Prior art probability games involve a game in which each game ticket is a potential winner. Each game piece includes a number of scratch off play areas concealing win or other symbols. To play the game, an individual removes the concealing material covering a specified number of the play areas to reveal the symbols beneath them. The player then determines whether the combination of revealed symbols results in a winner. A winning game piece may exist where all of the symbols are the same, add up to, or represent a winning combination. Each game piece includes at least one such winning combination, which contributes to the probability game's popularity.

The operation of the laws of probability control the number of players who successfully find a part of or the entire combination of symbols which produce the winning result. For instance, the probability of successfully locating the one location on a game piece which contains a winning symbol is greater if the player is allowed a number of chances rather than only one.

Probability games, however, poses some potential problems. The most significant of these problems is that of excessive prize purse liability. Although highly unlikely, every game piece has the potential of being redeemed. This could lead to massive redemption and uncontrolled amounts of prize liability. That is, every player could select the same numbers in a single game and all could claim a prize. This is not the same as in a game like Keno where the prize is pari-mutual and distributed among all claimants. In a probability game, the prizes are not pari-mutual and the sponsor would have to pay off at the stated amount for all the prizes redeemed. This is potentially very troubling.

Each probability game has two types of prize purse liability associated with it. The first type of prize purse liability is the amount of liability that is predicted to occur if the laws of probability operate as expected. This is referred to herein as the expected prize purse. But because of the chance of an unusual redemption coincidence, an allowance must be made for the highly unlikely event of massive redemption as described above. This is referred to as the maximum redemption liability. The maximum redemption liability is the amount of prize sufficient to cover all the game pieces if played to the maximum value and redeemed. This may be a very large number. It is common for lottery games to have five to ten million game pieces. If everyone had a potential prize value of 100 dollars, regardless of how remote the chances that all will be redeemed, the maximum redemption liability would be 1 billion dollars. It is not practical to set aside such a vast amount of money.

To cover the potential maximum redemption liability, the credit of the sponsor could be a bank against which these claims could be made. This is similar to the banking operations of a casino in Nevada or Atlantic City. In games such as roulette or craps, any outcome is possible. The number of winners and the amount of their winnings, although predictable to some certainty based upon the probability, cannot be guaranteed. A limit is therefore established to minimize the amounts won, no matter the outcome. This limit is further guaranteed by a bank backed by the credit of the casino. State lotteries do not allow for such banking to occur. States, when establishing lotteries, did not intend to authorize gambling houses and cannot run an unsecured lottery similar to one of a gambling house.

The potential large liability may make such a game uninsurable. Insurance underwriters do not wish to indemnify the prize purse when the liability is potentially uncontrolled. Because of these difficulties, the development and deployment of probability games has been slow.

Another problem associated with probability games is fraud and involves a situation where a player removes the covering material from more than the number allowed by the game. For instance, where a player is allowed six attempts to find the winning areas and instead takes seven or eight. Although this problem would seem apparently easy to handle due to the apparently clear violation of the rules, the redemption of the tickets is typically handled by clerks.

These clerks must be able to determine the value of a ticket, particularly because the tickets are not like those of dedicated games, which are either clearly winners or clearly losers. A probability game ticket could be much harder to read and may lead to mistakes by clerks. Therefore, what is desired is a way to handle fraudulent play while eliminating potential mistakes by clerks.

Game pieces are usually verified and authenticated by the use of an encrypted alphanumeric bar code. The code often appears twice on a ticket, once printed so that it is visible to the human eye and once printed and concealed on the game piece, via, for example, latex removable scratch off coating. Various methods have been used to make game piece redemption simple and secure. In simple form, authentication takes place when a bar code scanner reads the code printed in the clear and a clerk compares the code to the number that is concealed.

The currently most successful authentication procedure is a double encryption process in which a code is printed on the back of the game piece and an encrypted code placed under the latex on the playing side. After the game has been played, the playing side code number is revealed and a key code is entered by, for instance, a clerk which triggers an algorithm that matches the scanned number to (in the case of a valid ticket) the one printed under the latex. The success of the authentication assumes that the clerk enters the key numbers correctly and follows proper redemption procedures.

In a dedicated game, since each game piece is dedicated in value (i.e., has only one possible value), the decoded game piece number can be matched in a database and the value displayed for the clerk. The game piece can then be redeemed and the number removed from the data base to prevent further attempts at redemption for that particular piece.

Again, the weak link in this system is the clerk who enters the key code. If the clerk is clumsy, inefficient or busy, several attempts might be necessary to verify the piece. If the clerk is dishonest, he can misinform the client and attempt to suborn the game piece for himself. This has prompted manufacturers to find a more efficient and secure method of game piece verification and redemption.

Apart from the potential for human error and unscrupulous behavior, this authentication process is relatively secure. However, there is also a need to have the game pieces scored (i.e., the amount of winning determined), as well as authenticated. What is needed is a way to automate the entire process (both authentication and scoring) without requiring clerk involvement. Once such automation is achieved, more complicated games could be produced.

The present invention provides for a probability game that controls prize liability while accommodating the practical problems of player fraud and clerk mismanagement. The present invention also provides for automating the process of authentication and scoring.

SUMMARY OF THE INVENTION

A probability game is described. The probability game of the present invention has multiple game pieces. Each game piece has areas which are covered with a removable concealer. Each game piece also contains a number of playing areas which are either void or win areas, each of which has a code encrypting multiple prize values. In this way, the group of game pieces include guaranteed winners, guaranteed losers, and potential winners and in which the outcome is controlled by the laws of probability through player-made choices with respect to selecting areas to uncover on the game pieces that present winning indicia.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
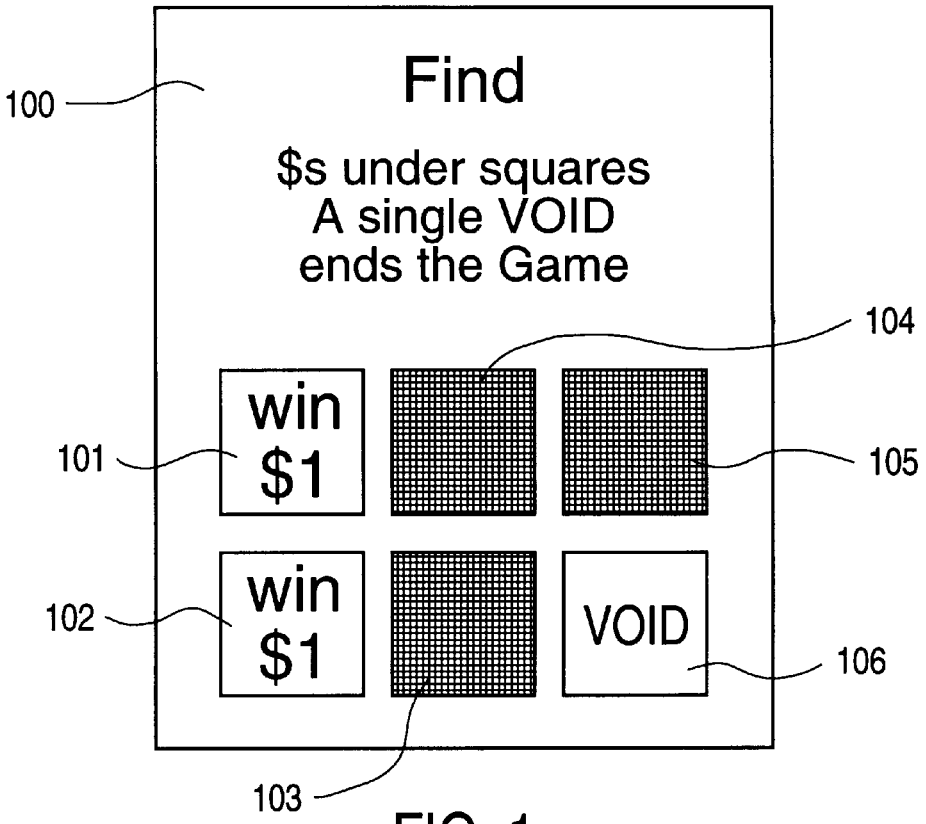
FIG. 1 illustrates an example of a partially uncovered game piece of the present invention.

A probability game is described. In the following description, numerous details are set forth, such as types of game pieces, directionals, clues, scanner/reading equipment, etc. It will be apparent, however, to one skilled in the art, that the present invention may be practiced without these specific details. In other instances, well-known structures and devices are shown in block diagram form, rather than in detail, in order to avoid obscuring the present invention.

The following specification includes copyrighted material. Applicant retains all rights in the copyrighted material included herein, but expressly allows for its copying for the purpose of copying the patent and its application.

Overview of the Present Invention

The present invention provides for managing a probability game in which every game piece is not a potential winner and the allocation of prizes is based on probability. The present invention provides for performing liability management by controlling prize amounts and by the mix of types of game pieces. In such a system, the probability of winning is controlled by varying the number of void areas on individual pieces. A void area may be equated to a lose symbol or indicia that indicates to the player that they have lost. The number of voids are varied such that the overall ratio of the number of voids to winners is changed to control the amount of liability. In this manner, the use of multiple voids controls the prize structure. In another embodiment, the probability of winning can also be controlled by including multiple winning amounts as well.

Each game piece could contain both void and winning areas. Some game pieces may have many winning amounts and a single void, while others may have many void areas and a single prize amount. Still others could have some combination between these two extremes or be entirely dedicated to either a losing or winning state. In this manner, the game pieces range from winners to losers. A winning game piece may exist where all of the symbols are the same, add up to, or represent a winning combination. The void and win areas are indicated by symbols or other indicia that are (initially) covered with a concealing, opaque material.

It should be noted that the term "game piece" may comprise both physical and virtual embodiments. For instance, game pieces may comprise physical tickets with playing surfaces (e.g., instant scratchers). On the other hand, they may also comprise virtual embodiments such as video, television, or other displayed game pieces. These virtual embodiments may be video, slot or game machine, computer network (e.g., Internet, World Wide Web, Intranet) video games and displays, etc. It should be noted that while play areas on physical game pieces may be covered in a removable concealer like latex, or other opaque material, the removable concealer in virtual embodiments may take the form of darkened or unreadable play areas on the display which is not physically uncovered, but instead is allowed to display the play area in a user viewable format when selected by the user to be "uncovered." Furthermore, any discussion of a game piece below encompasses both the physical and virtual embodiments.

The probability game controls redemption by discovering prize amounts. The redemption may also be controlled by limiting the number of attempts. If the player cannot find the prize in a limited number of attempts or if a void area is encountered, the game is over. The present invention uses a variable number of voids boxed off a game piece ranging from zero to the entire number of spots, or play areas, on the game piece. Each void area invalidates the game and stops the play.

Note that certain games may require a number of voids to be uncovered before the game ends and the player loses. For instance, 2, 3, 4, etc. voids may have to be uncovered before the game ends.

The present invention also allows for interactive play. Each game piece is played one spot at a time; however, any spot could void the game piece. Therefore, the responsibility for careful play rests on the player. That is, the player decides when to stop or when to go on. The player continues to play by uncovering a winning amount, encountering a null, directional or blank area or by voiding the game piece.

Also, in the present invention, there is no limit to the number of attempts a player may take. The player continues to play until a void is uncovered or until the player has collected all the prize (money) that can be obtained or until the player can no longer stand the risk that their next choice may void the game piece. In this manner, the player is provided with an incentive to quit playing based on their own judgment. The player weighs the risk versus the reward and decides whether to continue. Note that this is very different than the minimum performance required in the prior art probability game where to control the odds, the prior art games must require the player to pick a minimum number of times. The present invention frees the player of this burden.

In fact, in one embodiment, a player playing a game piece in which every spot is a winner may decide to stop playing and turn in the game piece when he has won only a portion of the potential prize value. Thus, the present invention allows a dedicated game piece to have multiple returns due to the player-made choice of deciding when to quit. This is clearly not present in the prior art.

FIG. 1 illustrates an example of a game piece of the present invention. Referring to FIG. 1, a game pieces is shown having a playing surface 100 with play areas 101–106. Play areas 101–102 are win areas which contain symbols that indicate dollar amounts won while play area 106 comprises a void, or lose, area (i.e., play areas containing a symbol indicating the ticket is void). In this case, playing surface 100 contains multiple prizes of the same value. In an alternate embodiment, the multiple prizes may have different values. As a player plays the game, the player removes the concealing material (e.g., latex) that covers each of play areas 101–106. The player may stop at any time, and there is no limit to the number of attempts the player can make. As shown, play areas 101, 102 and 106 have been uncovered, while play areas 103–105 remain covered (indicated by crosshatched marking for purposes of explanation). Since the player encountered a void by uncovering play areas 106, the player loses the $1 prizes that are uncovered.

Figure 2:
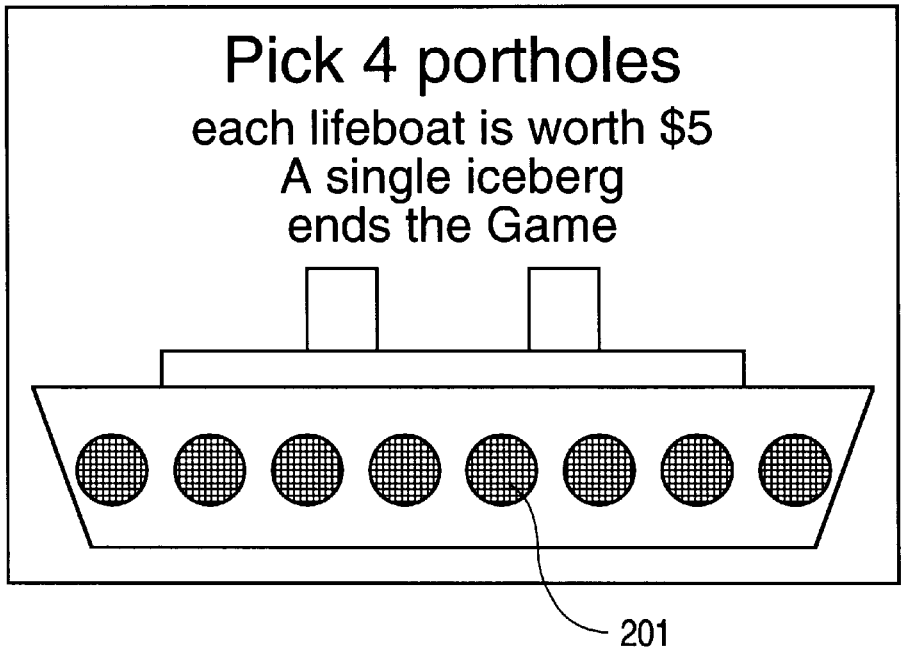
FIG. 2 illustrates an alternate embodiment of a game piece in which the play areas run across the bottom of the playing surface of a game.

FIG. 2 illustrates an alternate embodiment in which the play areas run across the bottom of the playing surface of a game. Referring to FIG. 2, circle play areas 201 are lined up along the bottom of a ship.

The present invention provides for cumulative prize winning. That is, each prize could be uncovered on a game piece with multiple winning amounts and what accumulates is the value of the ticket which would be allowed to climb as the game is being played. One or more void areas on a ticket may be selected and then cause forfeiture of the entire amount. As the amount climbs, the risk of selecting a void area increases. Thus, in such a case, the player has a powerful incentive to stop playing or face the potential loss of his prize. In other words, a player may settle for far shorter than the maximum amount available. However, because the player would not know this, player dissatisfaction would be completely eliminated with the amounts won since the player himself makes the decision whether to quit.

After accessing the maximum liability, pieces with multiple prizes would have to be funded to the maximum amount. Although the probability of the game of the present invention does not provide for all game pieces being winners, the player is not aware that the game piece they have bought is a seeded loser, and thus the game would remain interesting to such a person. Therefore, making each game piece potentially valuable with increased risk for each additional selection, the game becomes much more involving and more interesting.

It should be noted that with respect to the maximum prize liability, all game pieces do not have to contain a winner. Some of the game pieces may be winners, while others be losers, and yet others may be probable winners and losers. Since not all of the game pieces in the game need to be funded, the amount of the maximum prize liability can be reduced significantly.

By providing a probability game as described in the present invention, the maximum liability in the prize purse can be underwritten with an amount less than the amount taken in by sales. This is very important since it allows insurance underwriters to remain confident that even if a catastrophic break occurred, the game would not cost more than its income.

Types of Game Pieces

In one embodiment, the present invention provides for varying both the odds of selecting a winner and also the amount of the prize by including prize levels referred herein as losing winners and break-even levels. These levels are less than or equal to the amount of the purchase price of the game piece. By offering game pieces with less than or equal amounts of the purchase price, certain "winners" would actually redeem at less than face value or at actual face value.

One embodiment of the present invention includes the following types of game pieces: game pieces that are guaranteed winners, game pieces that are guaranteed losers, less than purchase price game pieces, equal to purchase price game pieces, and game pieces with varying winning amounts (determined by probability). The mixing of game pieces gives a projected redemption.

In one embodiment, a guaranteed winner has no void symbols and only one winning symbol. All of the remaining play areas on the game piece in the play surface are pass or free trial areas. The player may play all the way through the game piece if necessary removing all the concealing material from the spots with one or more blank areas offering him a chance to keep on going. Ultimately, the player uncovers the single winning symbol and the play stops.

A guaranteed losing game piece is one in which there are no winning symbols and either pass or lose symbols.

A minimum value game piece is a winner that either does not compensate the player for the full purchase price (i.e., win a dollar for a two-dollar purchase) or simply allow him to win only a free game. In the former case, a player has actually lost, but the sting of the loss is reduced because the player can redeem for a partial refund of the full purchase price. In the latter case, the player has actually won nothing, but another chance to play.

There are several types of minimum value game pieces. For instance, a minimum value game piece may be a forced minimum win where there is a single win spot and all others are try again. A minimum value game piece may be forced void where there are multiple void spots and all others are try again spots. A variable minimum value win game piece is one where there are varying numbers of values that total less than the purchase amount and both try again and void areas. A guaranteed minimum value win is where there are varying numbers of value still all totaling less than the purchase price but which also have a guaranteed minimum value. In one embodiment, the number of redemption at this guaranteed level depends on the number of such spots on the game piece. Just as with the winning or voids spots, the number of guaranteed minimum value spots uncovered can be predicted.

Figure 3:
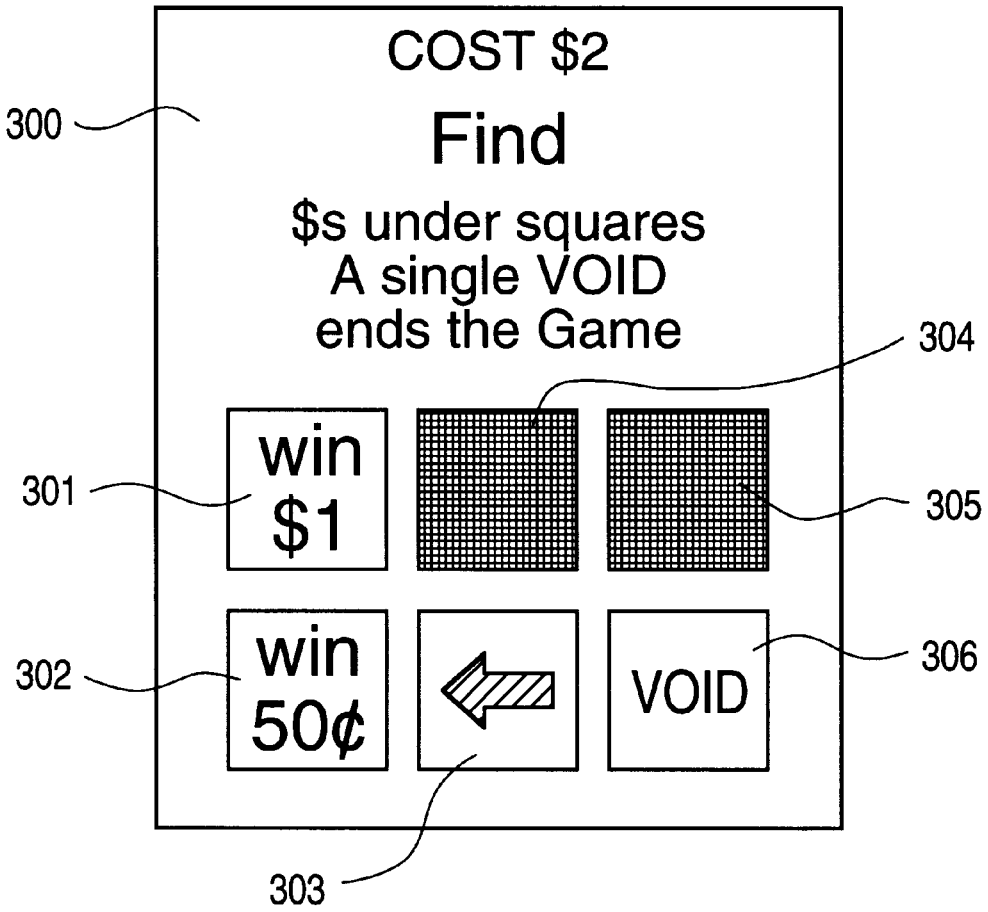
FIG. 3 illustrates an example of a variable minimum value game piece.

FIG. 3 illustrates an example of a variable minimum value game piece. Referring to FIG. 3, a game piece having a playing surface 300 with play areas 301–306 is shown. Playing areas 301–303 and 306 are uncovered, while play areas 304–305 remain covered (indicated by crosshatching). Note that the maximum accumulated prize is only $1.50, which is less than the purchase price of the game ticket. A combination game piece such as is shown in FIG. 3 may be included in a probability game. Pieces of this type may feature a variety of prize values such as break even amounts, some less than break even game pieces, some winning game pieces and some losing game pieces. Each of the game pieces may have different odds associated with the probability that a win results. Besides varying the probability of winning or losing by varying the winning and losing symbols, the amount won or lost could also vary. Thus, winning tickets could all have the same value, or each ticket might have a different value or the ultimate value might vary through player selection from a field of possible ticket values as part of the play of the game.

Play area 303 contains an arrow symbol, which is referred to herein as a directional. A directional directs player choices. Directionals are discussed in more detail below.

A break-even game piece is a winning game piece in which the player wins the purchase price of the game piece. It is important to remember that these game pieces contain void areas which will prevent many of these potential even money redemptions because there is a good chance that the game piece will be voided if more than one spot is revealed. Also, there is a good chance the player will stop before voiding the game piece. This is a neutral outcome to the sponsor since the player can only get his original purchase price back.

Break-even game pieces may include a forced break-even where a single break-even value win spot is on the game piece and all others are try again spots. It is also possible to have variable break-even tickets, where there is a varying number of winning amounts that total the same as the purchase amount and both try again and void areas.

It should be noted that the number of game pieces with varying numbers of winning areas compared to void, or losing, areas may be adjusted according to research results, client preference, and player psycho-graphic data. If there are many game pieces with multiple win areas and the chance to increase the award upon discovery of multiple prize areas, then the game is more exciting. In one embodiment, a game piece includes one or more multipliers, which may or may not have to be uncovered, that multiplies the prize value (e.g., doubling or tripling the prize value) if encountered.

Figure 4A:
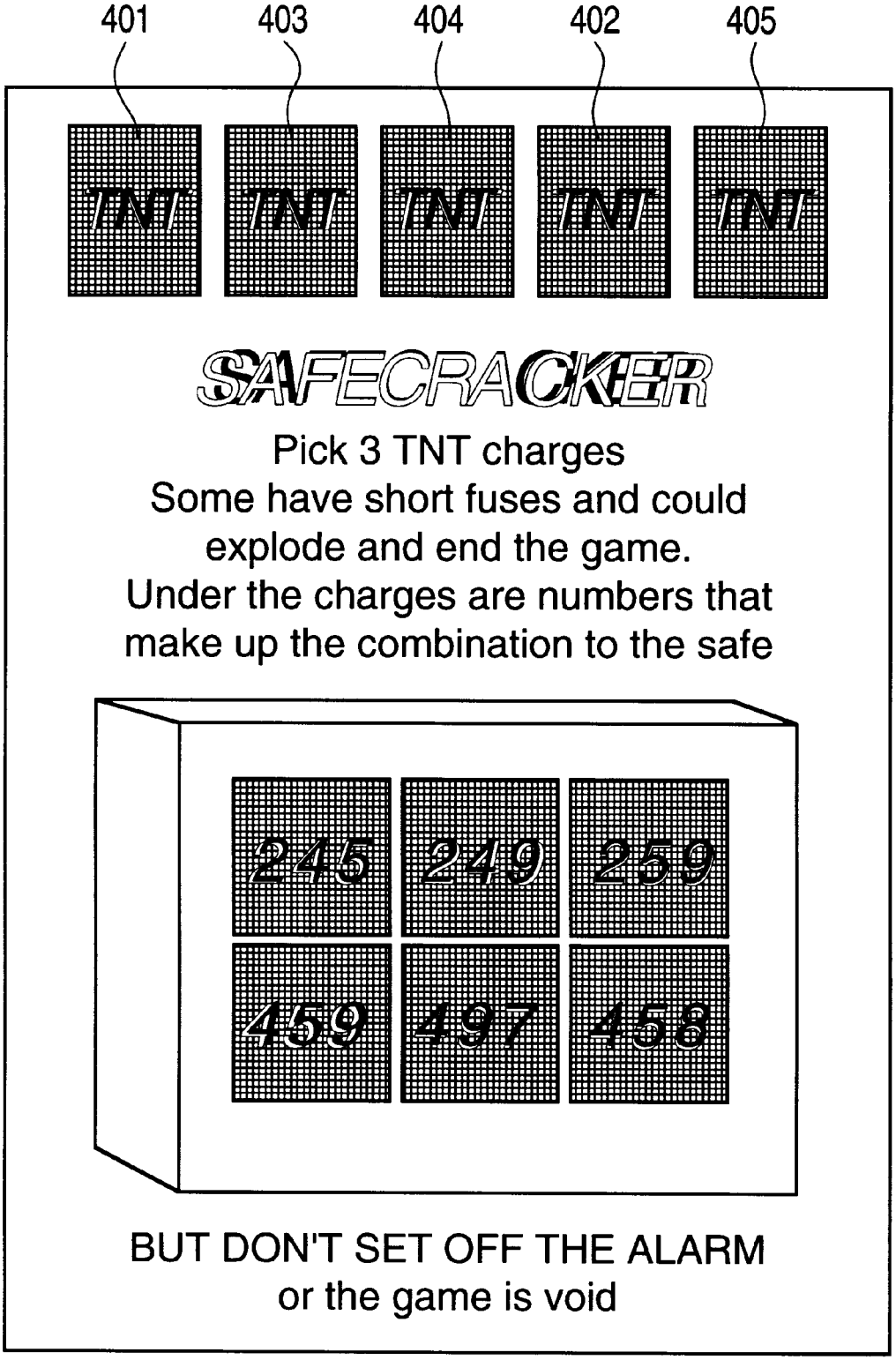
FIG. 4A and 4B illustrate exemplary safe cracker game pieces prior to play and completely uncovered, respectively.
Figure 4B:
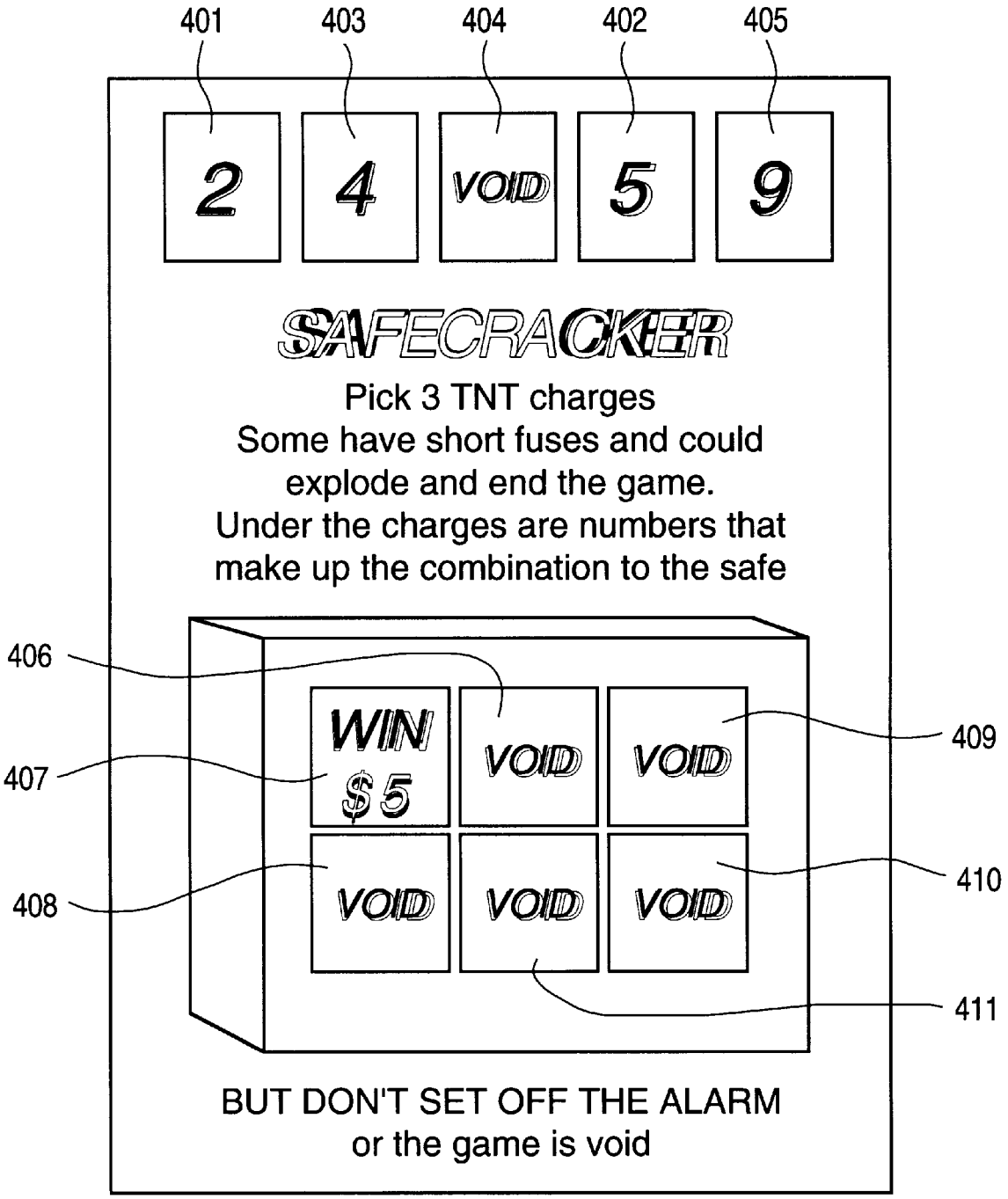

One embodiment of the game which may be a probability game according the present invention is referred to as Safecracker and is shown in FIGS. 4A and 4B. Safecracker is a game that has a two-tiered format. The player must pass a first tier before being allowed through to the second. The game may be viewed as two games: a qualifying game and a pay-off game. Specifically, the player discovers the combination to a safe before being allowed to try the combination on the safe allowing him access to the prize. The process of gaining the combination could end up in a void game piece even though the safe held a prize. Even if the player successfully crosses the first tier (i.e., discovers a combination without encountering a void play area), there is still risk because the combination the player has obtained might be faulty and end the game once again.

In one embodiment of Safecracker, there are five spots covered with latex in an upper tier and six in a lower tier. Thus, the upper portion of the playing surface is a five spot playing field. The first choice is among five spots (401–405).

FIG. 4A illustrates an exemplary Safecracker game piece prior to play. Referring to FIGS. 4A and 4B, in the first tier there is only one void area, 404, and combination numbers, 401, 402, 403, and 405. It should be noted that there could be more than one void area. Therefore, the probability of choosing the void area on the first attempt is 4 out of 5. The probability changes by one less for every choice thereafter for both the numerator and the denominator since there are fewer spots to pick from and fewer numbers to pick from as well. Since, in this case, three numbers will be required to form a complete combination, the actual probability would be $\frac{4}{5}\times\frac{3}{4}\times\frac{2}{3}$ which equals 0.80×0.75×0.66 or 0.396=39.6%. In other words, nearly 40% of all the players will clear the first tier and end up with a combination. Second tier probabilities are straight forward as well. There are six numbers and in this case only one combination has a reward and the remainder are voids (406–411). The odds are simply $\frac{1}{6}$ or 16.6%. Therefore, with this particular combination of symbols (one void in the top tier and five in the second tier), only 39.6%×16.6% or 6.59% of players will receive an award.

It should be noted that three numbers do not have to be required for the combination in other embodiments. Combinations of any size may be used. For instance, combinations may have only three or five or other amounts of digits for the combination.

Figure 4C:
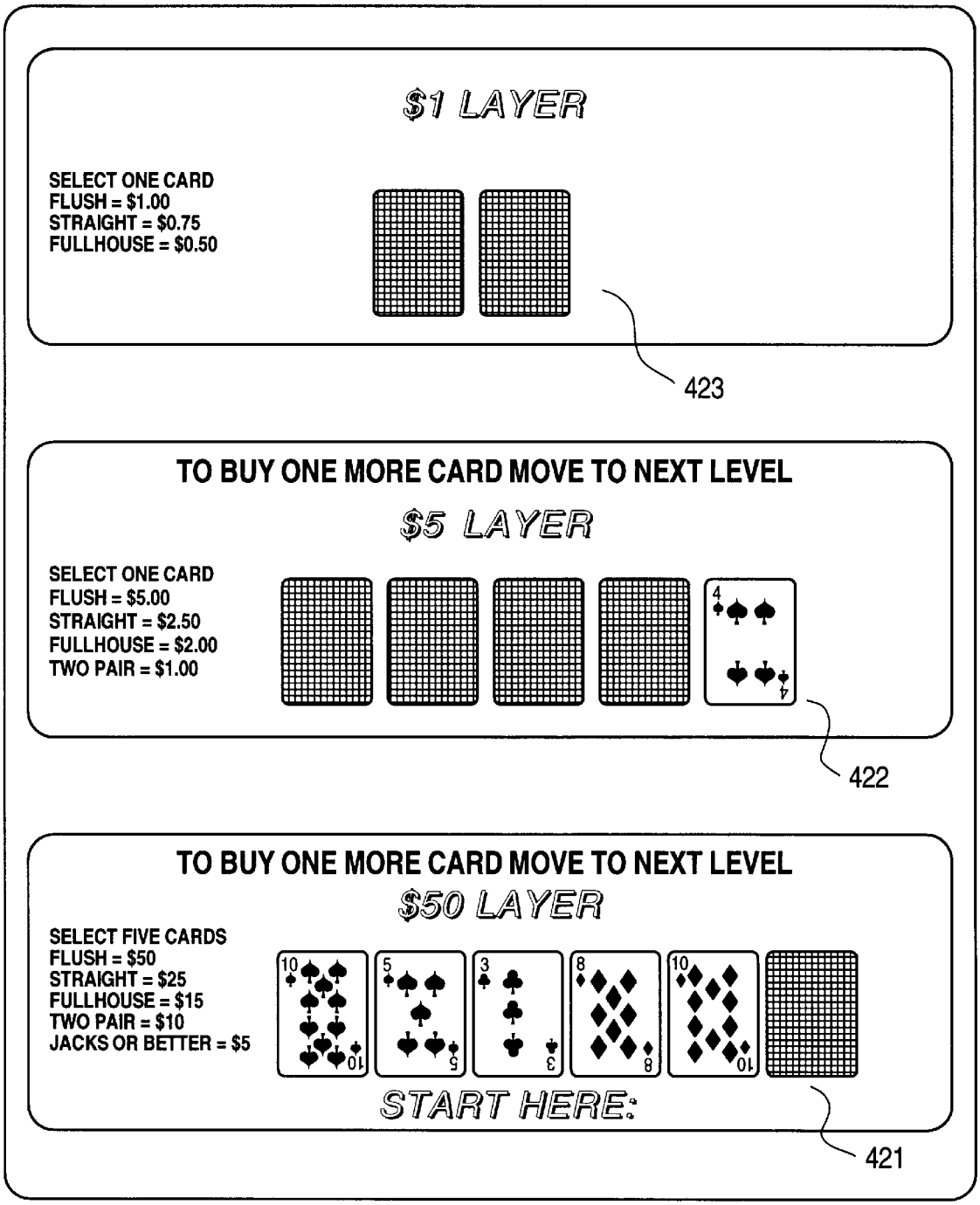
FIG. 4C illustrates an exemplary layered game.

FIG. 4C illustrates an example of a layered game in which the value of the prize automatically changes. Referring to FIG. 4C, the player initially rubs off five cards of playing surface 421. Prize values are indicated. If the player does not win with their original 5 cards, another card may be purchased. To do so, the player moves up to playing surface 422. However, there is a cost as the prize values go down. Still another card may be purchased and obtained at playing surface 423; however, again, the potential prize value drops further.

Thus, the probability game of the present invention provides a known number of winners and losers which will yield a known and predictable total prize liability based on laws of probability. Unlike a banking game, the preprinted game piece can only yield what is printed on the surface. All choices are not available to the player. The player will not change the amount of prize offered. Not all game pieces have an equal chance of being winners or of winning an amount greater than the purchase price.

Managing Player Interactive Play

The present invention also sets forth managing individual play of a probability game. The individual play is managed by one or more of the following: directionals, clues, and insurance.

In one embodiment of the present invention, each of the play areas on play surfaces of individual game pieces may include symbols that act as directionals. Directionals direct a player to play the game pieces a specific way. In other words, a directional directs an individual's choice as to which play areas to uncover on a playing surface.

In one embodiment, directionals take the form of arrows or pointers in the playing areas. Such an arrow may direct a player to play a particular playing area (remove the concealing material from that playing area). An example of this type of directional is shown in play area 303 in FIG. 3. In another embodiment, the directional may be a multi-pronged directional arrow (or pointer) that points to multiple locations or playing areas on the playing surface. These are referred to herein as choice directionals. It would then be the responsibility of the player to decide among the options provided as to which play area would be uncovered. Thus, the choice directionals force a player through a series of bridges, extending the play of the game. The odds of losing are increased by controlling the number of pathways a player must take. In this manner, choice directionals are an odds control element. Note that although the directionals may be arrows, any pointer indication may provide a similar function.

Figure 5:
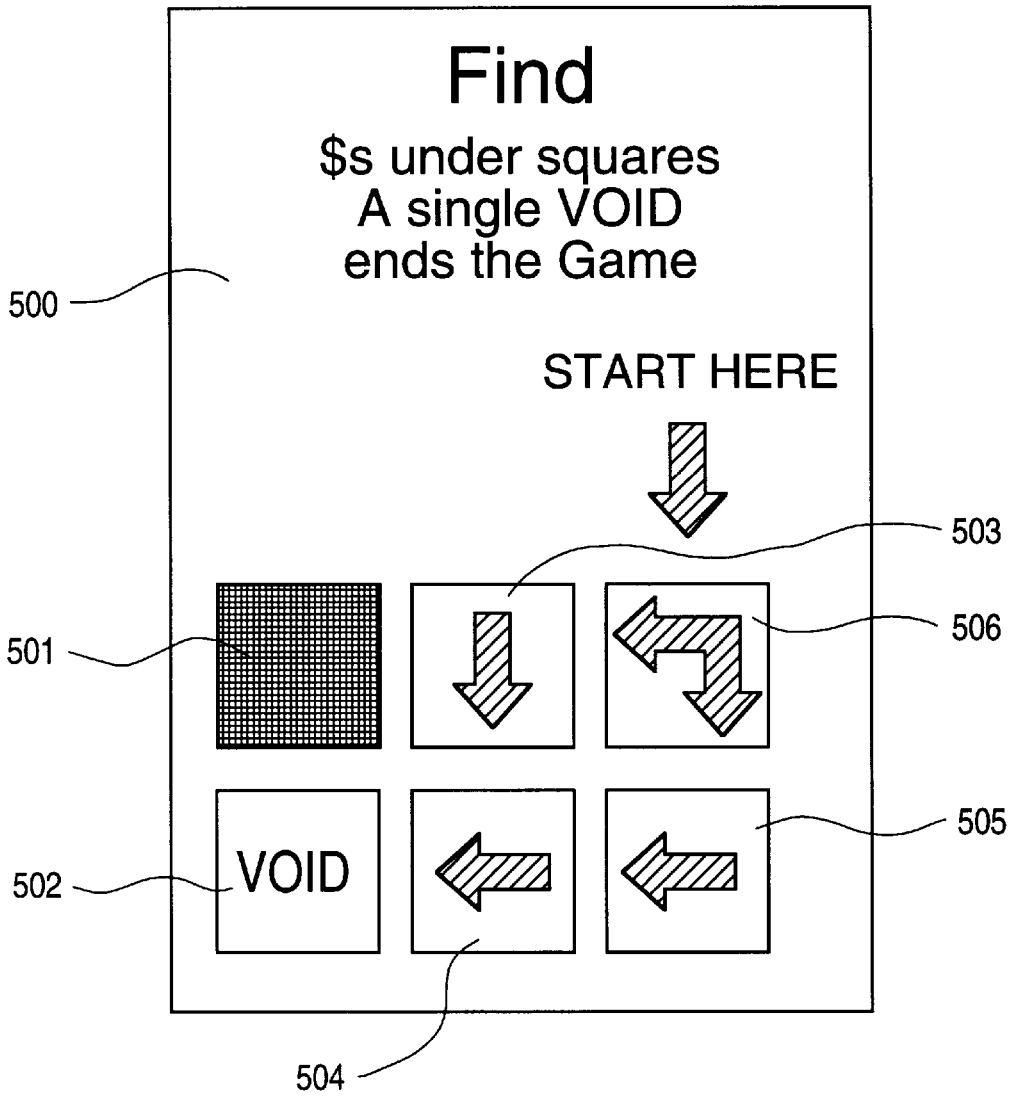
FIG. 5 is an example of a game piece that contains a multi-directional arrow.

FIG. 5 is an example of a game piece that contains a multi-directional arrow. Referring to FIG. 5, the game piece contains playing surface 500 having play areas 501–506. Play area 501 has a prize symbol (concealed); play area 502 has a void symbol; play areas 503–505 have uni-direction directional symbols, and play area 506 contains a multi-direction directional symbol. The multi-directional arrow at play area 506 gives the player the choice of going to play area 503 and 505 next. The game piece in FIG. 5 is a seeded loser in which there is no way to win. Such a game could be won if insurance is purchased as described below.

Figure 6A:
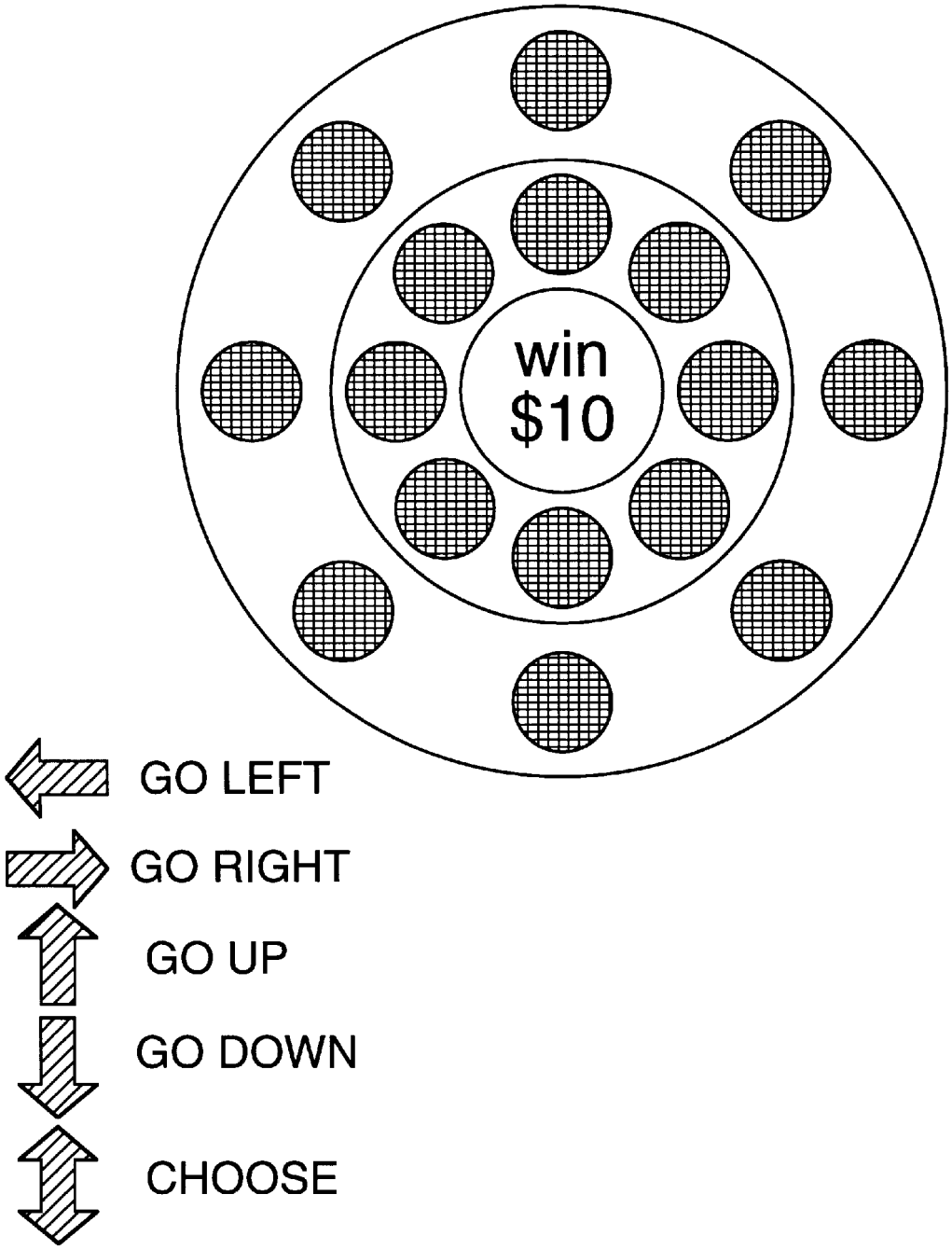
FIGS. 6A and 6B illustrate a Ringer game piece unplayed and completely uncovered, respectively.
Figure 6B:
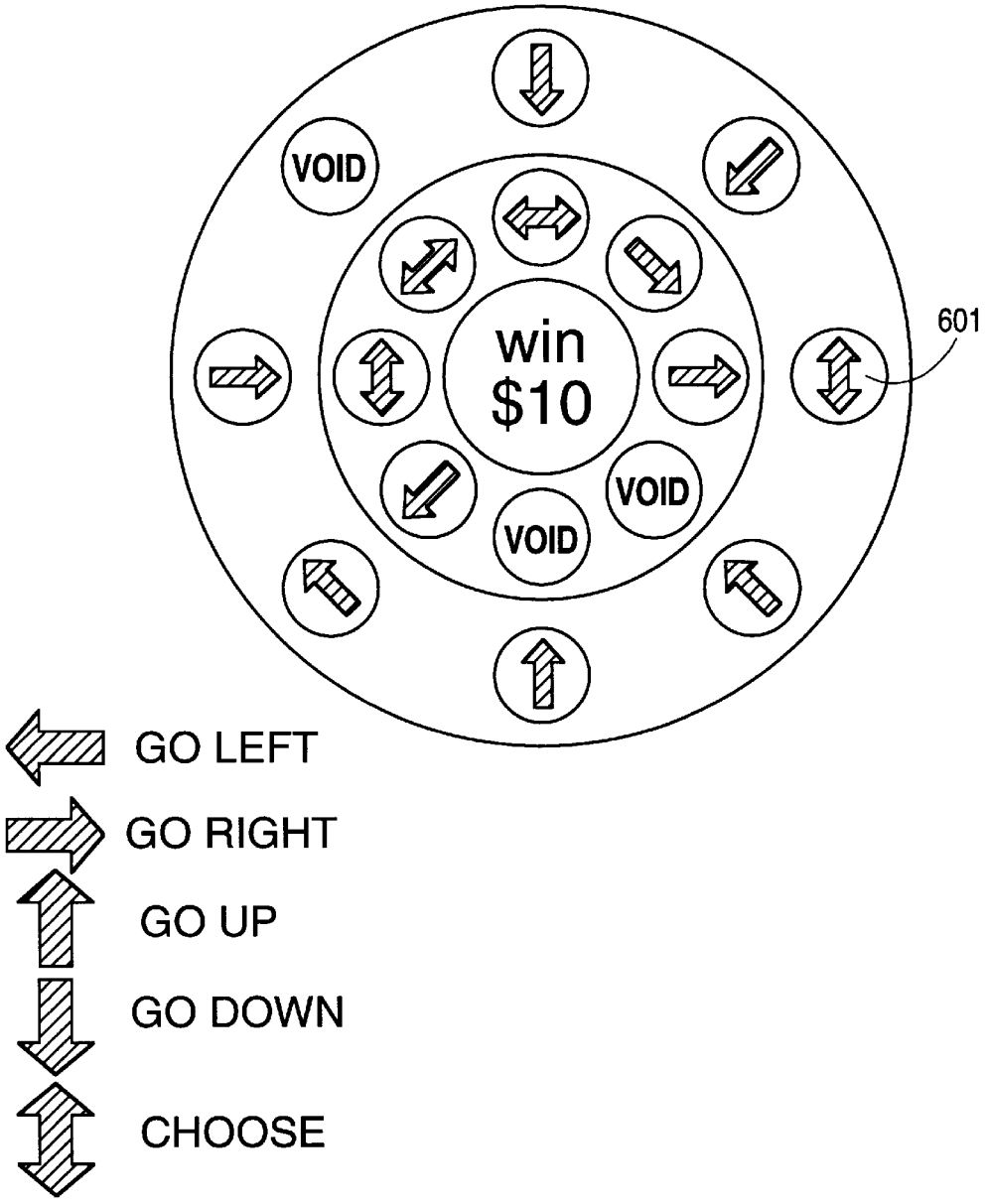
Figure 7A:
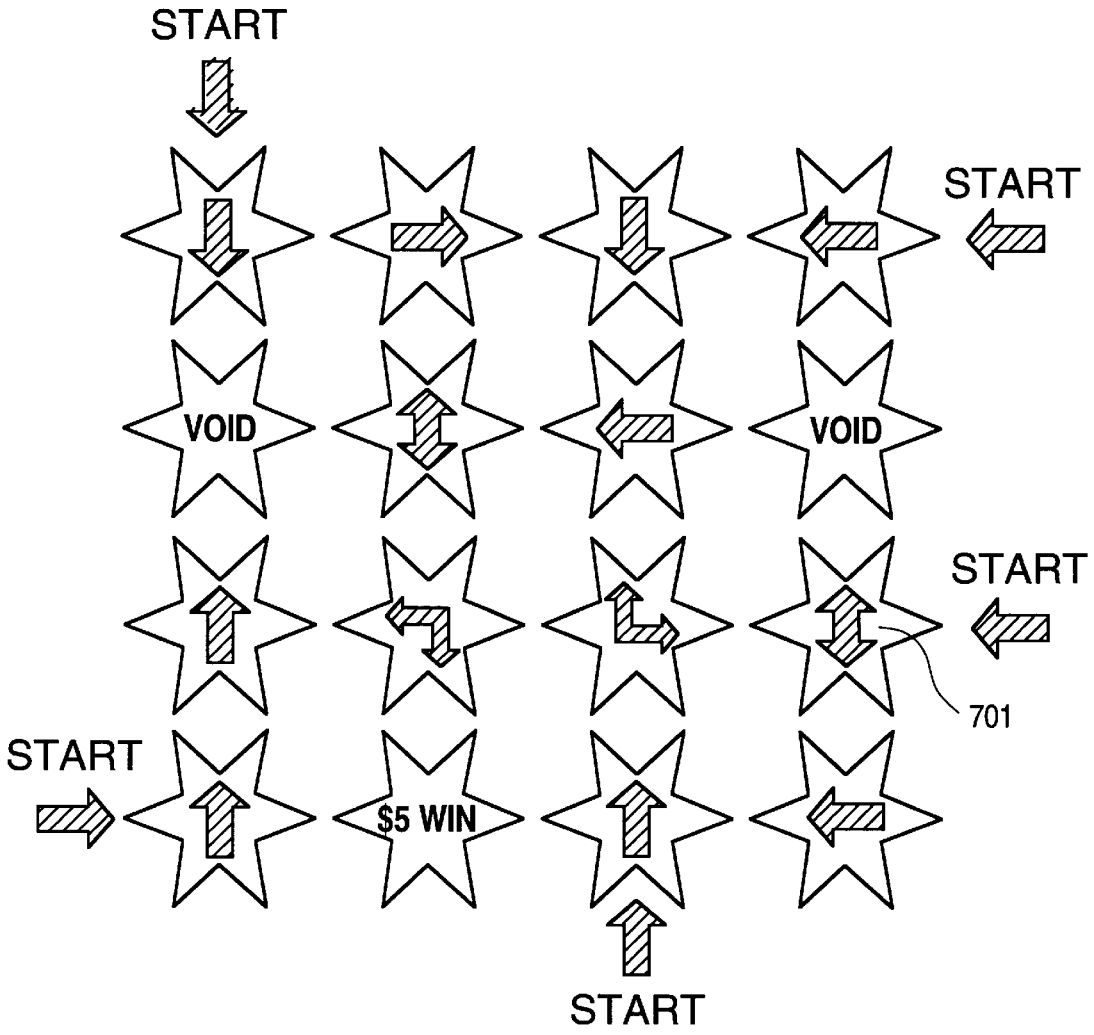
FIG. 7A is an uncovered game piece for a Field of Stars game containing multiple choice directionals.

FIGS. 6A and 6B and 7A illustrate two other examples of using choice directionals. FIGS. 6A and 6B illustrate a Ringer game piece unplayed and completely uncovered, respectively. Referring to FIG. 6B, a choice directional 601, among others, is shown. FIG. 7A is a game piece (uncovered) for a Field of Stars game in which multiple choice directionals, such as directional 701, are shown.

In another embodiment, a directional may take the form of hint or clue. For instance, a hint or clue may indicate whether the player is approaching a win spot or approaching a void area. An example of such a clue directional is a phrase "getting warmer" or "you're hot". Such indicators direct the player in selecting a play area to uncover.

Figure 7B:
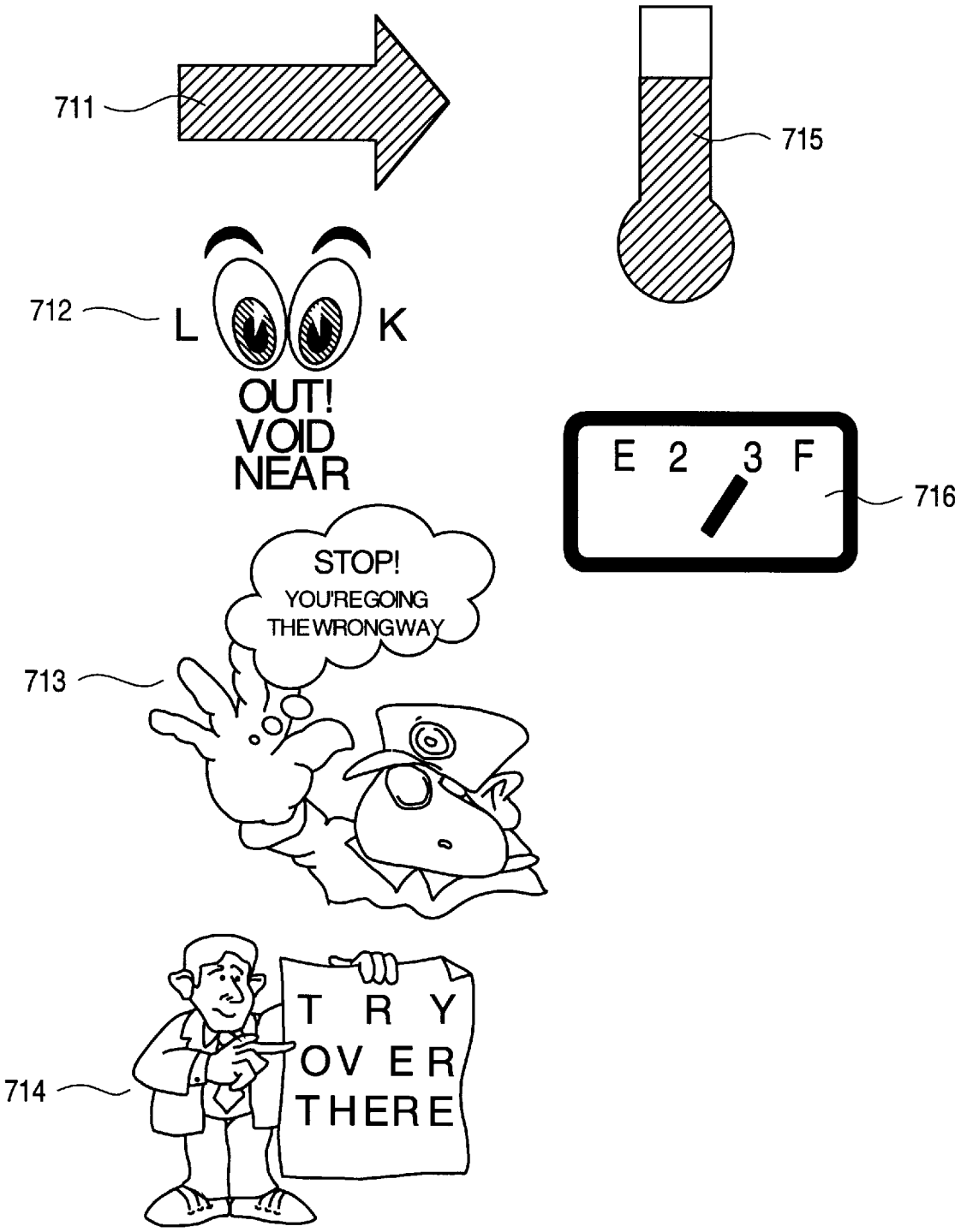
FIG. 7B illustrates examples of directionals.

FIG. 7B illustrates examples of directionals. Referring to FIG. 7B, directionals are shown to include a pointer 711, a verbal directional such as 712–714 and a thermometer type directional 715, and a gauge type directional 716.

Any type of clue may be used to help a player to reduce the number of potential candidates to be uncovered while playing the game may constitute a directional. In one embodiment, clues are given outside the playing area on the game piece and may have to be scratched off. In one embodiment, the more clues used the lower the value of the ticket. That is, as more clues are used, the value of the game piece decreases.

Figure 7C:
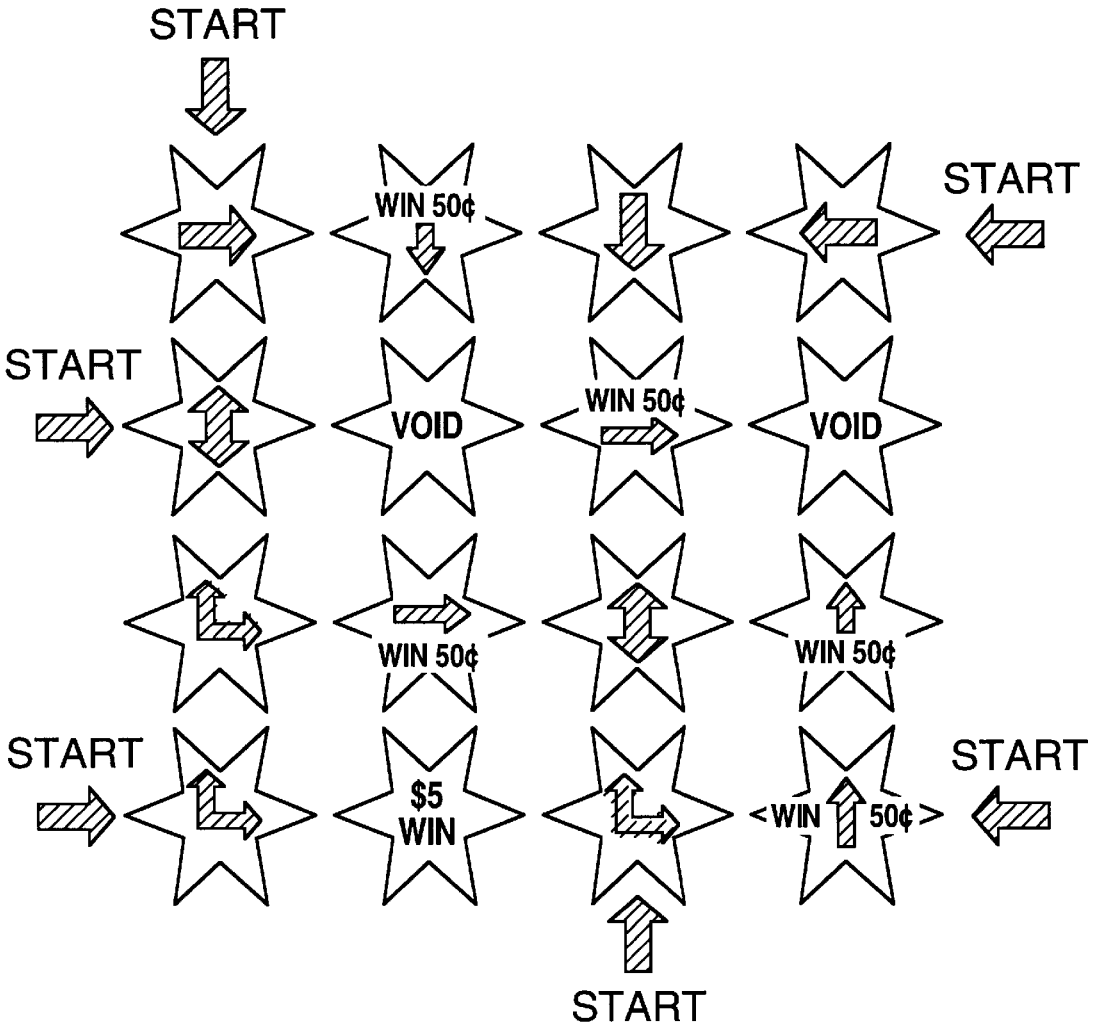
FIG. 7C is an alternate embodiment of an uncovered game piece for a Field of Stars game with a teaser prize in order to add player interest.

FIG. 7C is an alternative embodiment of an uncovered game piece for a Field of Stars game with a teaser prize in order to add player interest. Referring to FIG. 7C, the game piece includes a number of starting arrows to indicate to the player where to start to play. Note that the game piece may have only one such start arrow. Regardless of which arrow is chosen by the player, the player is guaranteed to encounter a win area early during the playing of the game piece. This is a teaser prize that is small in comparison to the prize of the game piece and/or a potential large prize; however, the presence of the teaser prize raises the price of loss to the player as a winning amount is already being risked by continuing to play. Thus, risk is being added to the game while not costing the sponsor much at all. After uncovering the teaser prize, directionals direct the player's choices of the next play areas to uncover, if desired.

As shown in FIG. 7C, each play area may include two (or more) symbols such as an arrow and a prize amount. In one embodiment, many play areas include one or more symbols.

Insurance

In one embodiment, a player may purchase insurance for the game piece. The insurance may be purchased at the time of purchasing the game piece or in an alternate embodiment may be purchased prior to encountering a void when playing the game piece. The insurance may be designed to compensate for a variety of situations. For instance, by paying insurance, the player may be immune from losing when uncovering their first void area. In another embodiment, insurance can be paid to enable the player to encounter a predetermined number (e.g., 2, 3, etc.) voids without having the game piece become void. For example, in the case of the game piece in FIG. 3, if a player had insurance, the void at play area 306 would not void the game piece and the player would have collected the prizes at play areas 301 and 302.

The use of such an insurance scheme for game pieces requires some form of recording to ensure that a player who pays insurance gets proper credit for the insurance. In one embodiment, the fact that an insurance fee was paid can be indicated by using a different type of game piece, such as one with a different color, graphics, etc. In another embodiment, the game piece may be physically altered, for example, by stamping or printing with some special ink or an indication that sets forth that insurance has been paid. In another embodiment, the game piece may be physically altered by hole punching, tearing, etc., the ticket to indicate that insurance has been paid. In still another embodiment, the game piece may be appended with an indicator such as with a barcode, digital paper indication, or sticker indicating that insurance has been paid for the game piece.

Figure 8:
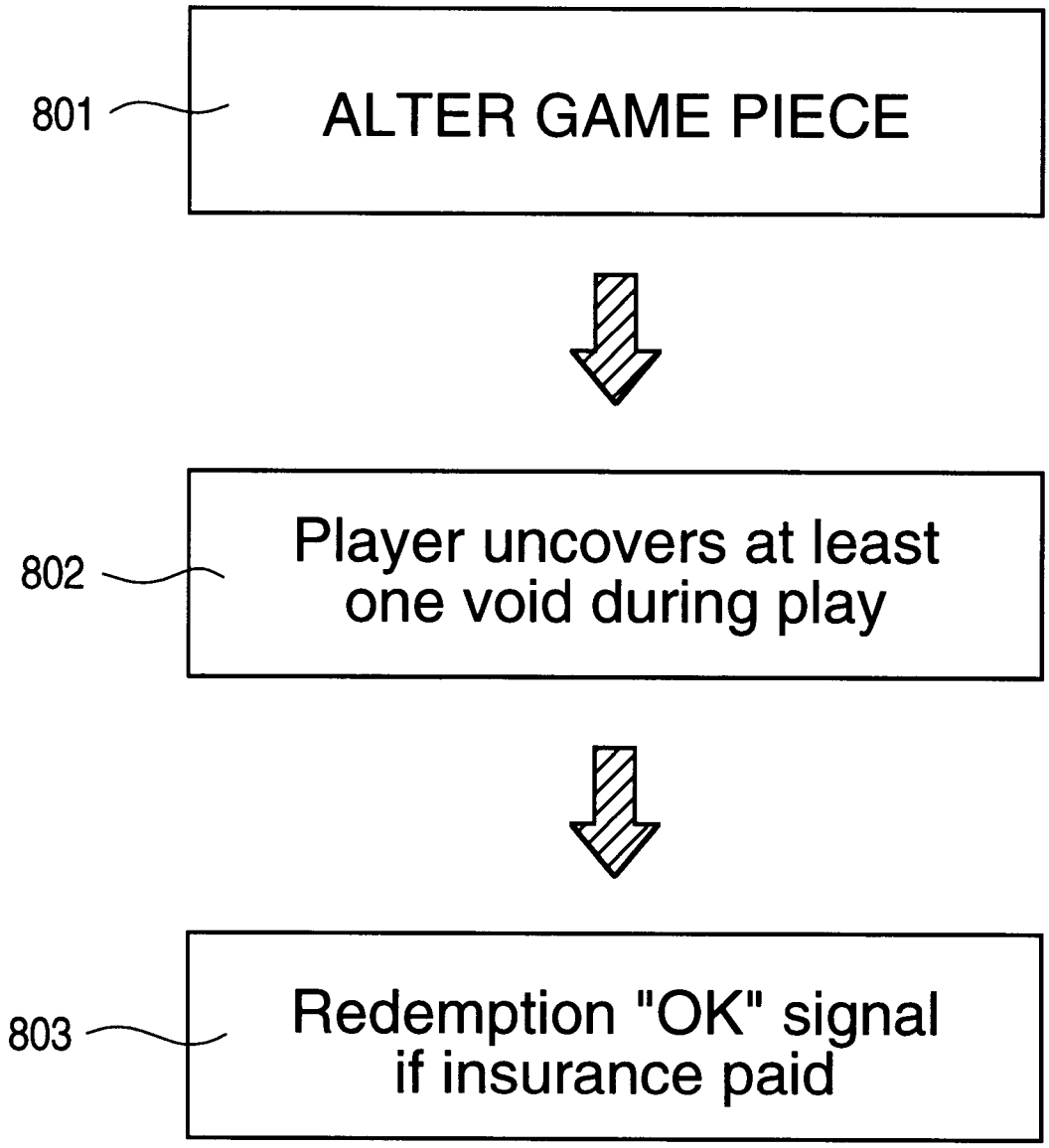
FIG. 8 illustrates one embodiment of playing a game with insurance.

FIG. 8 illustrates one embodiment of playing a game with insurance. Referring to FIG. 8, the process to accommodating the insuring of game pieces includes changing the playing surface in a predetermined manner prior to encountering a void area (processing block 801). Then, the player uncovers play areas on the playing the surface (processing block 802). Then, a redemption allowed indication is signaled during redemption where there are uncovered win areas and an uncovered void area when it is determined that the playing surface has been changed in the predetermined manner to indicate that the insurance has been paid (processing block 803).

Because the potential for people duplicating the changes to the game piece in an unscrupulous manner to obtain free insurance, an automated insurance process is more desirable. In such a case, no change need be made to the game piece itself. In one embodiment, a storage area storing status information for each of the pieces is maintained. Such a storage area may be a database or other type of storage medium. Upon payment of insurance, the database is accessed typically from a remote location (over a network) in a manner well-known in the art. In one embodiment, this may be performed from a remote point of sale terminal such that the system storing the data is accessed through a network or other type of communications medium using a void if removed number (VIRN). At this point, the status in the database for that game piece is changed to reflect the fact that insurance has been paid. The particular data in the database may be written to indicate that insurance has been paid. Thereafter, the player may continue playing the game and, when redeeming, an automatic reader or scanner accesses the database by using, for example, the VIRN and a redemption allowed indication would be signaled based on the presence of win areas being uncovered despite the presence of an uncovered void area. When gaining access to the database, the status value is used and software determines that insurance has been paid and the predetermined number of allowable void areas (or less) were identified on the game piece.

Scoring and Redemption

While the present invention provides more play style, its also places an additional burden on lottery clerks and could cause confusion at redemption centers. These lottery clerks must now be able to distinguish winning tickets from losing tickets, and locate and match both winning and losing symbols upon the pieces. The present invention avoids these problems by provided a method and apparatus for scoring games pieces.

In one embodiment, a remote scoring device is used to determine the amount of winnings. The probability game of the present invention uses an instant game piece validation process that offers a more efficient, secure method of handling instant lottery games. The validation process of the present invention automatically moves a ticket through a scanner that confirms whether a prescribed amount of latex has been removed, or scratched, from the game piece's play area. The game piece then moves past a bar code scanner that reads the bar code printed on the game piece.

The present invention sets forth scoring methods which use the verification code on the game piece itself as part of scoring the game piece. All game pieces have identifying numbers which allow the operator to identify the game piece. Each game piece has matching numbers that are stored in a computer archive (e.g., memory, hard disk, CD-ROM, etc.). When a game piece is redeemed as a possible winner, that number is used to verify that it is an active game piece.

The present invention provides for using slot and wand readers that are capable of reading alphanumeric characters and bar coding which is indecipherable to human beings. Slot and wand readers are well-known in the art. In this manner, the present invention allows game pieces to be printed such that no one but the scanner could read them.

Figure 9A:
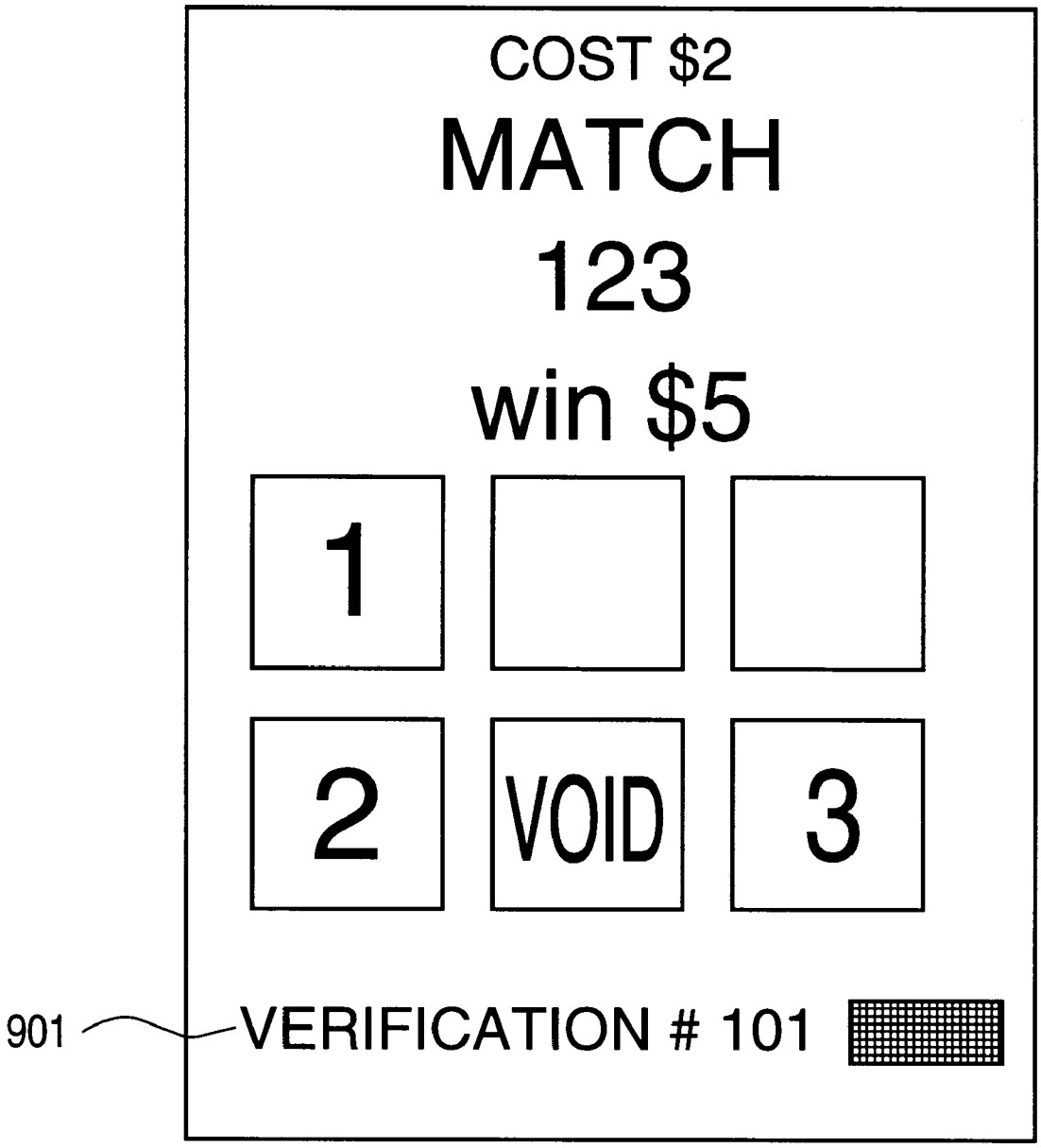
FIGS. 9A and 9B illustrate two methods for scoring of game pieces.
Figure 9B:
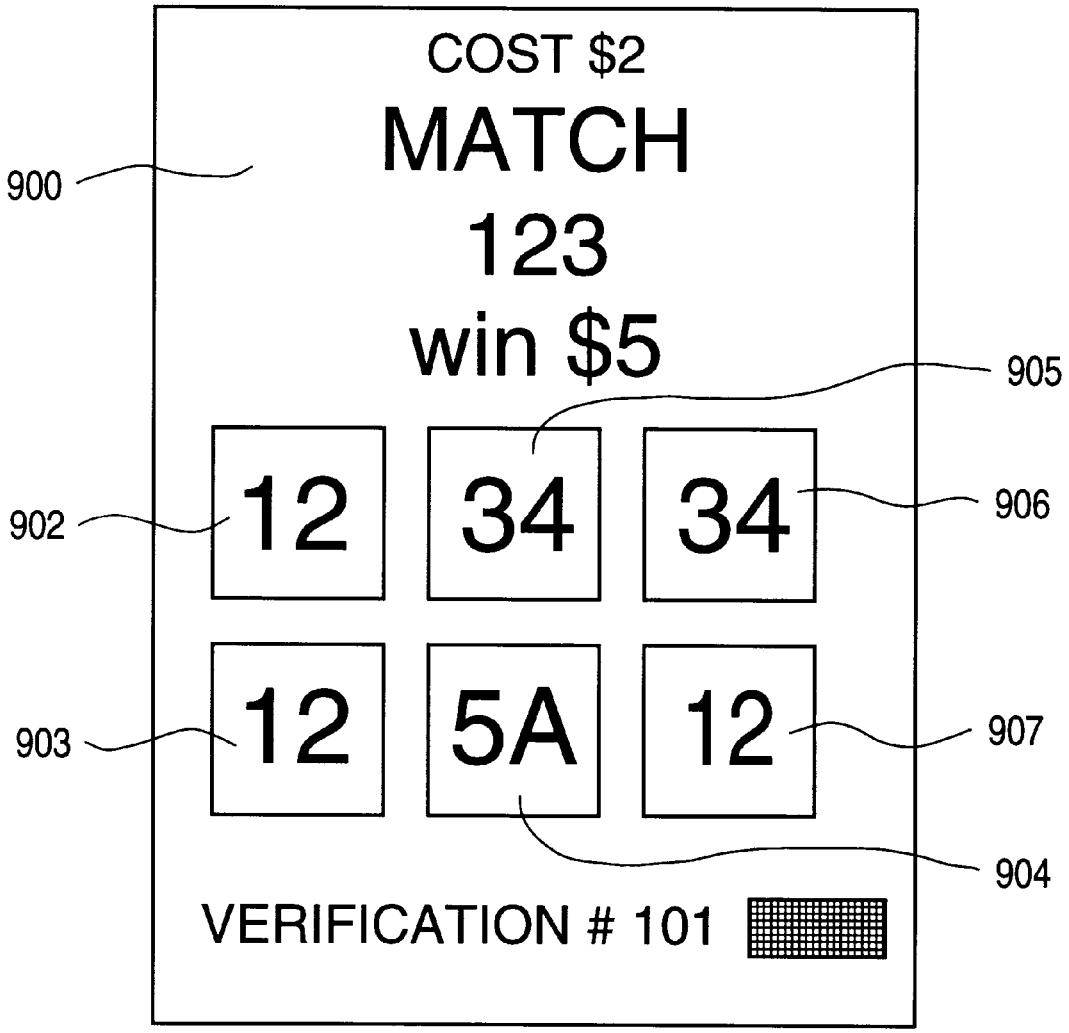

FIGS. 9A and 9B illustrate two methods for scoring of game pieces. Referring to FIG. 9A, a verification number, (VIRN), such as 901, is scanned by a bar or wand scanner and sent to a computer (not shown) for activation. Each verification number is unique. In one embodiment, the number is printed and clearly visible on the playing surface. When the game piece is redeemed, the verification number 901 is rescanned and compared to an indication in a database in memory to see if it is an active game piece. An additional copy of the verification number 901 may be encrypted under the VIRN area on the card to prevent swapping the number from game piece to game piece. In one embodiment, each number is encoded for security.

In one embodiment, the bar code or other machine readable code or character is printed under every latex covered play area. On most spots where a winning value appears, one type of bar code could appear while on blank areas another could occur. On losing or void areas, a third code could appear. Depending on which codes the scanner sees, the output can be analyzed and interpreted.

FIG. 9B illustrates a game piece of the present invention that has improved features to facilitate scoring. In one embodiment of the present invention, the scoring information is divided into small alphanumeric bits that are scattered over the playing surface of the game piece. Referring to FIG. 9B, the code "12" falls over win areas, such as play areas 902, 903 and 907; the code "5A" falls over void areas, such as play area 904, and nulls, directionals, blanks, or try again areas have a code of "34," such as play areas 905 and 906. Any machine readable code scheme could be used (e.g., ASCII, etc.).

When scoring, the entire surface is scanned and the resulting data stream compared to a matching number in the computer. In the case of FIG. 9B, the number looks for six numbers and letters to score. For example, if the sequence 12345A is sent to the computer, then it would be scored as a VOID, while 123434 would be scored as a win. Numbers that remain covered are not read by the computer and are not scored.

The computer system to perform the scoring uses scanner technology that is currently available, requires little additional hardware or software modification and requires little clerk retraining.

Thus, the present invention provides a bar code scoring of game pieces using conventional bar code readers, such as wand scanners and slot scanners, to authenticate and score game pieces such as those commonly used in lottery scratch-off games or commercial games.

Figure 10:
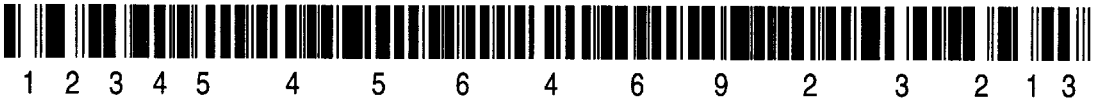
FIG. 10 illustrates an example of a bar code.

Current scanners read a start symbol in a group of characters and then a stop symbol. In one embodiment, the present invention removes the stop code from the present authorization code and adds a null or repeating unit that operates as a place holder to space out the distance between latex covers. These place holders can be changed for every game piece and can vary on the game piece. An example of a bar code is shown in FIG. 10.

The present invention combines the winning and losing symbols and the authorization code into a single longer code group. The stop code has been moved to the end of the new longer code. Also, certain code symbols are dedicated to representing, voids and blank areas. At appropriate places in the authentication code, place holders are incorporated so that win, lose and blank areas fall under the latex covered play areas on the playing surface. This longer code may be printed under the Void If Removed Number (VIRN) latex area on the game piece.

Figure 11:
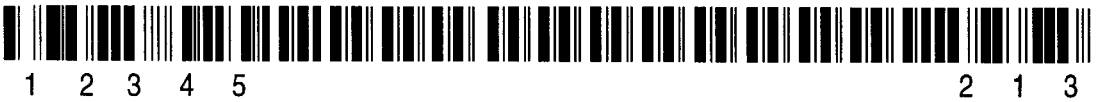
FIG. 11 illustrates an exemplary bar code for an unplayed game piece.
Figure 12:
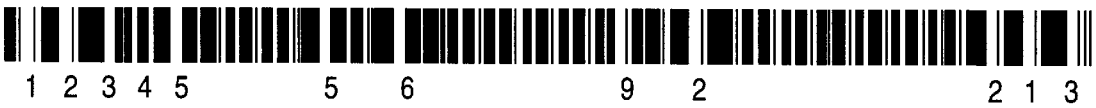
FIG. 12 illustrates a bar code from a used game piece.

An exemplary bar code for an unplayed game piece is shown in FIG. 11. When compared with the VIRN, the scoring program judges the game pieces unplayed. If the game piece had been played and two spots were removed, the scanner would read the code shown in FIG. 12. In this example, a group of 56 and 92 appears. When this is compared with a code printed in the clear area, it triggers a second level authorization which would indicate that a void has been generated. If the scanner sees on a single group 56, it would trigger a first level of authentication which would indicate a single winner area has been uncovered. It is important to note that each game piece could have its own unique symbols for win, void and play.

Note that the two different processes are being carried out simultaneously with this equipment. In the first case, the game piece is being scored. In the second case, it is being authenticated.

The use of this scoring method requires that a game piece covered with latex be scanned or viewed to reveal the winning areas. The scoring method is vulnerable to misreading latex residue that might remain if a piece were insufficiently cleared of covering.

Assuming the game piece play area has not been cleared completely of latex and part of the bar code is obscured, since the machine is comparing a clear code with an obscured one, the reading or scoring device could be programmed to make certain judgments regarding the second code. If the code nearly matches but one character does not, the device may inform the player or the clerk to recheck the play area. This could be done by inserting a logical branch in the scoring software program. In one embodiment, if an indistinguishable number were received, the machine displays a different message than if the numbers were clearly read.

In an alternative embodiment, infrared (IR), ultraviolet (UV) or colored ink could be used to allow use of much thicker or taller bars and reduce the chance of latex blockage. In one embodiment, the entire play area is printed with lines that run from top to bottom, so that a small particle of latex does not obscure the code. In such a case, a fraudulent player could identify a pattern but would have no idea what the pattern meant. Since each game piece would have different symbols for the win, void and blank areas, the player could not crack a group of pieces.

In one embodiment, the scanner could infer that a bar, even if broken in the middle, was in the appropriate place even if large blots of latex were covering the play area but the scan and the bar code extended beyond that area (in invisible ink) . Since the underprinted code is encrypted, a fraudulent player would have to obtain the encryption keys and decrypt the code before inferring which areas were win areas and which are not. To gain access to the encrypted key, the VIRN covering would have to be removed, voiding the ticket.

In still another alternative embodiment, a finer latex which flakes into smaller particles than those currently in use could be used so that an entire bar would not be obscured.

Figure 13:
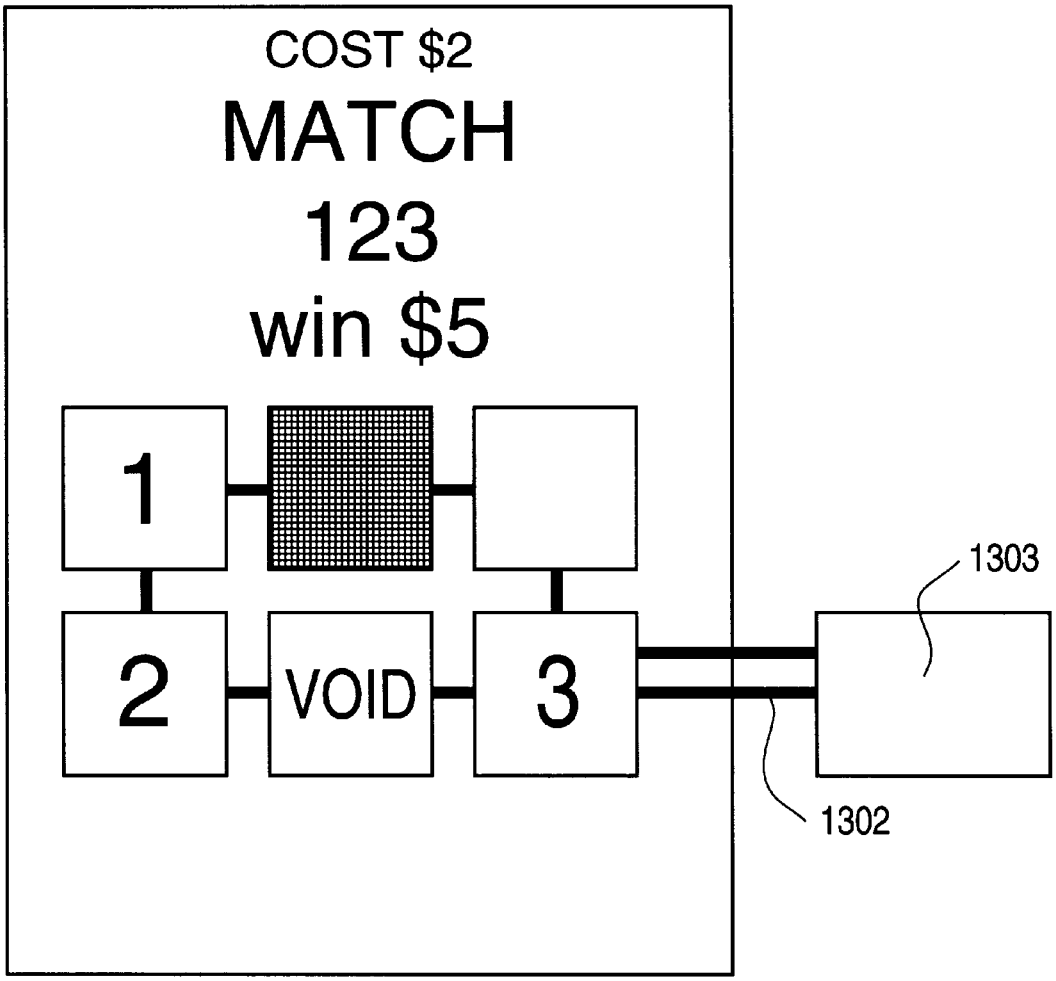
FIG. 13 illustrates an alternative approach to scoring game pieces.

FIG. 13 illustrates an alternative approach to scoring game pieces. Referring to FIG. 13, each play area is connected to the next by a printed circuit. As each play area is uncovered, as indicated by the solid lines, the connection is changed. The completed card circuit becomes part of the overall circuit which runs from a remote sensing device 1303 through a line 1302 and over the surface of the playing card. The measurement of that completed circuit, including the resistance, conductivity, etc., are used to provide information regarding the condition of the playing surface. Such information then enables scoring. Such an approach is described in U.S. Pat. No. 5,475,205.

Figure 14A:
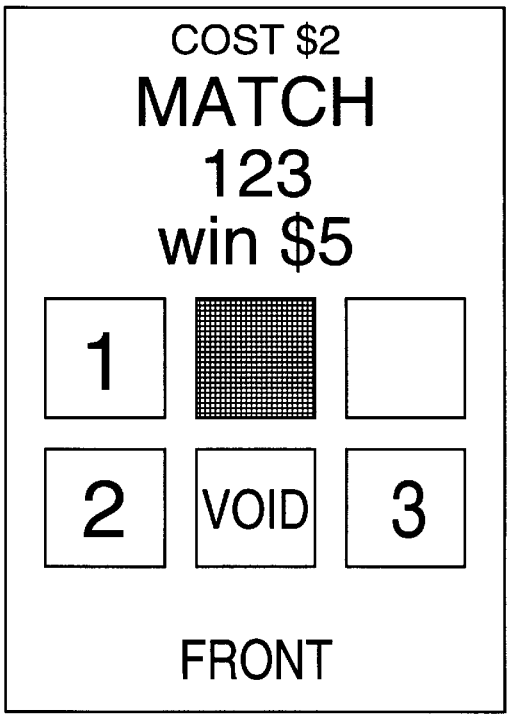
FIGS. 14A and 14B illustrate an alternative approach that does not use the circuit.
Figure 14B:
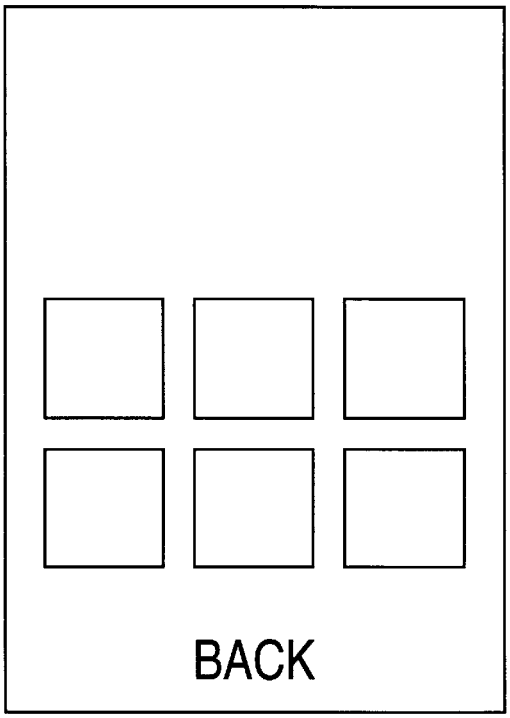

FIGS. 14A and 14B illustrate an alternative approach that does not use the circuit. Referring to FIGS. 14A and 14B, a duplicate of the front play area is printed in readable ink on the back of the playing surface as shown in FIG. 14B. The back is not to be played by the player. This can be ensured by using material which is not removable. Therefore, the player has access only to the front of the card. As the player removes the latex, the readable ink covering the play area is also removed. The remote sensing device and its accompanying equipment compares the front with the back of the playing surface and matches the electrical signature of both sides. That information is converted into alphanumeric information sent to remote site for comparison and interpretation.

Figure 15:
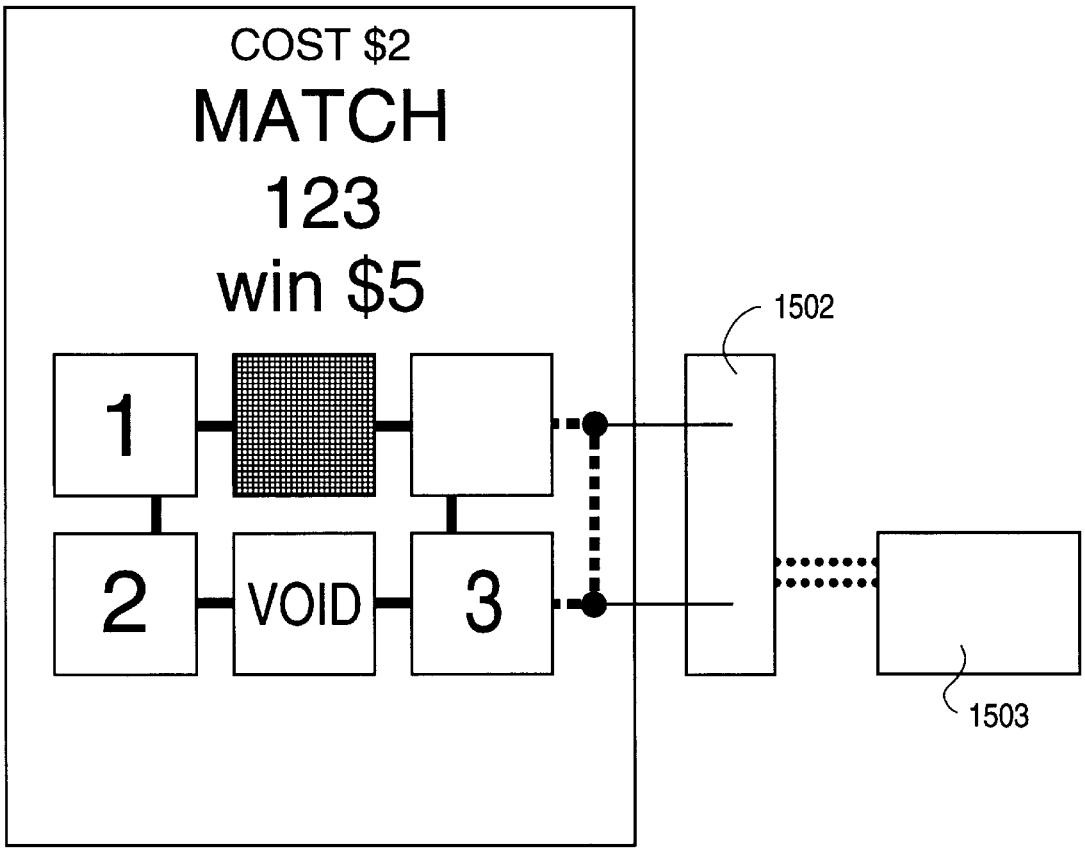
FIG. 15 illustrates another alternative approach.

FIG. 15 illustrates another alternative approach. Referring to FIG. 15, the remote sensing device 1501 is not part of the original circuit. Instead, the electrical signature is stored in a card and read by an intermediary device, such as reader 1502, where the electrical signature is converted into alphanumeric code. The alphanumeric code is then sent to a remote sensing device where it is interpreted. The information is sent back to the intermediary device which displays the results. Note that in this case, the card stores the information only. It has no direct contact with the remote sensing device 1501 in which the interpretation takes place. The intermediary device has no electrical connection to the remote sensing device either; however, it does have a data connection. The electrical information is converted into alphanumeric information before sending it for analysis. Thus, the devices are not part of the same circuit and the total electrical signature of the circuit is not read. Information from one circuit is translated into alphanumeric code by a reader and sent to a remote device for authentication and interpretation. These last two devices have no direct electrical connection with the first.

Scoreable Game Piece

In one embodiment, the present invention provides a scoreable lottery game piece which uses a remote scanning device to evaluate the score achieved on the game piece. The present invention also provides for preventing additional credits against the same piece once scanned.

Figure 16:
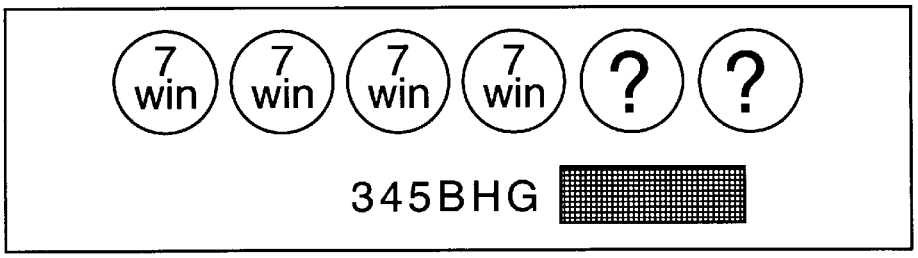
FIG. 16 illustrates an example of a game piece.

In one embodiment, every piece has a field with symbols covered by latex. when the game has been played the latex would be removed. An example of the game piece is shown in FIG. 16.

Figure 17:
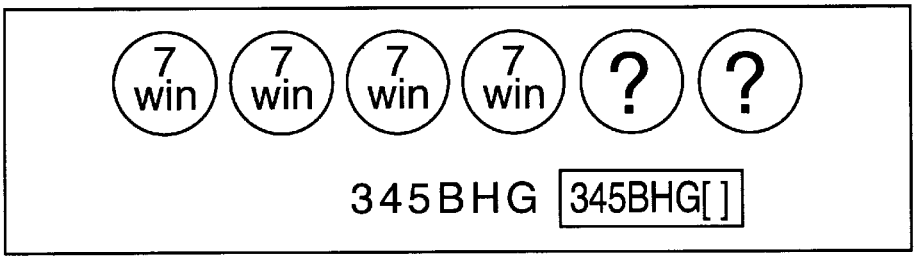
FIG. 17 illustrates a game piece with the VERN removed.

In one embodiment, when the clerk receives the game piece and removes the VIRN exposing a matching code number, an area that has been imprinted with a slow acting ink is exposed and becomes visible within minutes. FIG. 17 illustrates the game piece with the VIRN removed. There are a variety of inks which could be used. Iron based (Ferrous and Ferric Sulfide) inks slowly darken when exposed to the oxygen in the air. Photo sensitive inks (Silver Nitrate) darken when exposed to light. Certain inks produce different colors which would be visible in wand or scanner light only or would develop under UV light.

Figure 18:
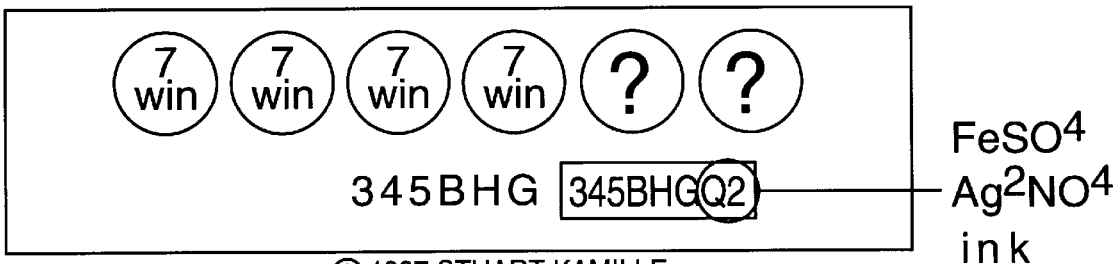
FIG. 18 illustrates that a game piece with an additional number appearing in its code.

Once the view area is cleared by the clerk, the blank area is activated. Printed in a slow developing ink which will slowly darken when exposed to oxygen or light; the "blank area" will soon develop an additional number (or letters) which will be scannable. For a short time (e.g., 5 minutes), the scanner can read the card ID and the code on each winning spot. This time period allows scanning even if the clerk makes an error and needs to rescan the card. Until the ink develops, the scanner will be able to read the card ID correctly. However, after the short time period, the extra character causes the card to be invalidated. In an alternate embodiment, a black out field could be used which would obliterate the card code. FIG. 18 illustrates that the group of symbols "Q2" has appeared in the code. This will cause the game piece to be voided.

Figure 19:
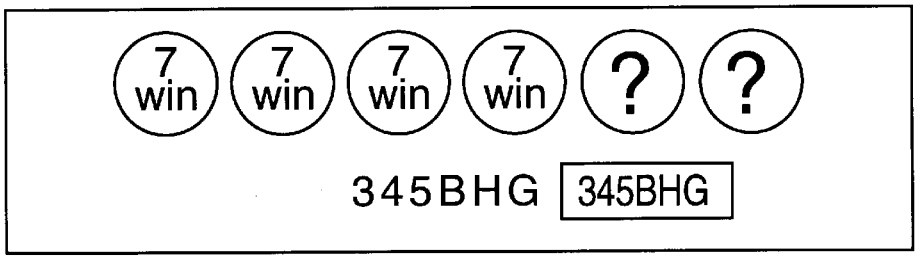
FIG. 19 illustrates the use of a number of the card ID representing the number of winning spots printed on the ticket.

In the example of FIG. 19, the second number of the card ID (4) represents the number of winning spots printed on the ticket. This is compared with the number of winning symbols actually uncovered. For instance, the alphanumeric code 7 represents a winning symbol identifying a winning spot. The number of 7's uncovered by the player is compared with the second number in the ID. Since they match, the maximum payoff is shown to the clerk. If fewer than 4 "7's" are revealed, a suitable deduction would be made. As an example, if only 3 winners (3 "7's") were uncovered, the present invention deducts 1 winner in value from the maximum value.

The use of slowly developing inks allows an interesting variant of the traditional lottery game. In one embodiment, the play area is revealed by rubbing off the covering and the winning spots slowly develop revealing the prize. The verification then may proceed.

Layered Decryption

In one embodiment, the present invention uses a decryption key in a multi-layer process to facilitate scoring and authentication. As a simple example, each game piece has a key associated with it, such as the number 8. The present invention divides by the uncovered number. If that number is 4, then the results of the division is 2. However, in the case that two key numbers are uncovered, the scanner sees both the number 4 and the number 2. If the same number 8 is divided first by 4 and then by the number 2, the result of the two division operations equals 1. Thus, if only one winning area is uncovered, it will decode to a different level or layer than if two numbers are entered. Notice the actual numerical amount is not important in this example. The fact that the values differ is. Thus, any number could be assigned to a game piece and be divisible by numbers in the game areas, which are exposed.

Although in this example numbers have been used, letters or combinations of both could be used. Also each game piece is unaffected by which key number is read first. The key directs the redemption process to a different layer of decryption. A game piece with four levels of decryption as an example will decrypt to the first level if any one of the four symbols is uncovered.

Thus, the scoring (counting the number of winning, blank and losing spots) and verifying share the same very reliable method of authentication. If the revealed numbers under the latex are transported from another game piece in an attempt at forgery, then the decryption key will yield an invalid authentication code. If void symbols are uncovered, the game piece is voided. If no winning symbols and no losing ones are uncovered, then the game piece has no value at all.

This method of the present invention does not require installation of new equipment in the redemption facility; however, it does require the preparation of new algorithmic keys and software to be programmed into the existing equipment, which would be apparent to those skilled in the art.

In summary, the present invention provides numerous improvements and benefits over the problems of the probability game in the prior art. First, by using void and win areas, multiple guesses by players carry risk that was not presented in earlier probability games. This discourages overplaying the piece. Second, by allowing the player to choose when to quit, confusion over the prize amounts that are won is avoided. Third, since there is no limit to the number of chances a player can take, he is much more likely to be satisfied with the outcome. Furthermore, by using a mixture of game pieces that includes some dedicated game pieces, some probability and some probability with less than or equal to the purchase price value, the maximum prize purse can be greatly reduced. Because the maximum prize purse can be reduced, a bank is no longer needed and insurance coverage can be gained for the game. Moreover, by automating the scoring and handling, clerk confusion and error is eliminated.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

Thus, a probability game has been described.

I claim:

1. A probability game having a plurality of game pieces in which each game piece comprises a plurality of areas covered with removable concealer, wherein each of the plurality of game pieces contains a plurality of play areas with combinations of void and win areas having codes encrypting multiple prize values so that the plurality of game pieces include guaranteed winners, guaranteed losers, and potential winners in which an outcome is controlled by the laws of probability through player-made choices with respect to selecting playing areas to uncover on the game pieces.

2. The game defined in claim 1 wherein the code comprises a machine readable code.

3. The game defined in claim 2 wherein the machine readable code comprises a bar code.

4. A probability game having a plurality of game pieces in which each game piece comprises a plurality of areas covered with removable concealer, wherein each of the plurality of game pieces contains a combination of void and win areas so that the plurality of game pieces include guaranteed winners, guaranteed losers, and potential winners and in which an outcome is controlled by the laws of probability through player-made choices with respect to selecting areas to uncover on the game pieces, and further wherein each of the game pieces includes a machine readable code encoding win areas, void areas, and an authentication code.

5. The game defined in claim 4 wherein each win and void area is represented in the machine readable code with a dedicated symbol.

6. The game defined in claim 4 wherein each of the game pieces encodes win and void areas uniquely.

7. The game defined in claim 4 wherein the win areas, void areas and authentication codes are represented as spaced-apart symbols.

8. The game defined in claim 7 wherein each code identifying a win area, a void area and the authentication code is separated by a marker.

9. The game defined in claim 7 wherein each code identifying a win area, a void area and the authentication code is separated by a null marker.

10. The game defined in claim 4 wherein the machine readable code is printed across a majority of the game piece.

11. A game comprising a game piece with a plurality of playing areas covered with removable concealer, wherein the playing areas comprises at least one win area, at least one void area, and a machine readable code encoding said at least one win area, said at least one void area, and an authentication code.

12. The game defined in claim 11 wherein each win and void area is represented in a bar code with a dedicated symbol.

13. The game defined in claim 11 wherein the game pieces encrypts a plurality of prize values in the machine readable code.

14. The game defined in claim 11 wherein the win areas, void areas and authentication codes are represented as spaced-apart symbols.

15. The game defined in claim 14 wherein portions of the machine readable code identifying a win area, a void area and the authentication code are separated by a marker.

16. The game defined in claim 14 wherein portions of the machine readable code identifying a win area, a void area and the authentication code are separated by a null marker.

17. The game defined in claim 11 wherein a machine readable code is printed across a majority of the game piece.

18. A method of scoring a game piece comprising the steps of:

scanning locations on the game piece designated as containing at least one code printed originally under a concealer to identify uncovered portions of said at least one code;

comparing the uncovered portions of the first code to a second code appearing on the game piece to simultaneously authenticate the ticket and identify whether win or void areas on the ticket have been uncovered.

19. The method defined in claim 18 further comprising the step of indicating whether any void area has been uncovered based on comparison of the uncovered portions of the first code to the second code, and indicating that the game piece is void if at least one void area has been uncovered.

20. The method defined in claim 19 further comprising the step of indicating whether any void and win areas have been uncovered based on comparison of the uncovered portions of the first code to the second code, and indicating that the game piece is a winner if no void area have been uncovered and at least one win area has been uncovered.

21. The method defined in claim 18 wherein the step of scanning locations on the game piece comprises providing operator feedback that an area being scanned is producing an unidentifiable reading.

22. The method defined in claim 18 further comprising the step of calculating an outcome of the game piece based on presence of any uncovered win and void areas.

23. The method defined in claim 18 further comprising the step of dividing a verification number associated with the game piece by a set of one or more numbers associated with any uncovered areas to determine a value for the game piece.

24. A game having a plurality of game pieces in which each game piece comprises a plurality of areas covered with removable concealer, wherein each of the plurality of game pieces contains a plurality of play areas, each of the play areas including a code encoding information which is revealed when uncovered during play and is scanned to determine scoring.

25. The game defined in claim 24 wherein the code comprises a machine readable code.

26. The game defined in claim 25 wherein the machine readable code comprises a bar code.

27. The game defined in claim 24 wherein the code comprises a first machine readable code when identifying winning areas and a second machine able code, different than the first machine readable code, when identifying non-winning areas.

28. The game defined in claim 27 wherein the code comprises a third machine readable code, different than the first and second machine readable codes, when identifying non-winning and non-losing areas.

29. The game defined in claim 27 wherein the non-winning areas comprise void areas.

30. The game defined in claim 24 wherein at least a portion of the plurality of game pieces have unique symbols for encoding winning and losing areas.

31. The game defined in claim 24 wherein each of the game pieces encodes win and void areas uniquely.

32. A game comprising a game piece with a plurality of playing areas covered with removable concealer, wherein each of the playing areas comprises at least a first or second machine readable code encoding scoring information which is uncovered when said each play area is uncovered during play and is scanned to determine scoring, wherein the first machine readable code identifies a winning area and the second machine readable code, different than the first machine readable code, identifies a non-winning area.

33. The game defined in claim 32 wherein each win and void area is represented in a bar code with a dedicated symbol.

34. The game defined in claim 33 wherein the machine readable code comprises a bar code.

35. The game defined in claim 34 wherein the playing area comprises a third machine readable code, different than the first and second machine readable codes, when identifying non-winning and non-losing areas.

36. The game defined in claim 32 wherein the non-winning areas comprise void areas.

37. The game defined in claim 32 wherein at least a portion of the plurality of game pieces have unique symbols for encoding winning and losing areas.

38. The game defined in claim 32 wherein each of the game pieces encodes win and void areas uniquely.

39. A method of scoring a game piece comprising:

scanning at least one play area on the game piece to read at least one code originally under a concealer and revealed during play; and determining whether the at least one code uncovered during play indicates a winning or non-winning area to score the game piece.

40. The method defined in claim 39 further comprising indicating whether any void area has been uncovered based on comparison of a first code revealed during play of one play area to a second code, and indicating that the game piece is void if at least one void area has been uncovered.

41. The method defined in claim 40 further comprising indicating whether any void and win areas have been uncovered based on comparison of codes uncovered during play to a first code and to a second code, different than the first code, and indicating that the game piece is a winner if no void area have been uncovered and at least one win area has been uncovered as determined by the comparison.

42. The method defined in claim 39 further comprising providing operator feedback that an area being scanned is producing an unidentifiable reading.

43. The method defined in claim 39 further comprising calculating an outcome of the game piece based on presence of uncovered codes indicating win and non-winning areas.

44. The method defined in claim 39 wherein the code comprises a machine readable code.

45. The method defined in claim 44 wherein the machine readable code comprises a bar code.

46. The method defined in claim 39 wherein the code comprises a first machine readable code when identifying a winning area and a second machine readable code, different than the first machine readable code, when identifying a non-winning area.

47. The method defined in claim 46 wherein the code comprises a third machine readable code, different than the first and second machine readable codes, when identifying non-winning and non-losing areas.

48. The method defined in claim 46 wherein a non-winning area comprises a void area.

49. A system for scoring a game piece comprising:

a scanner to scan at least one play area on the game piece to read at least one code originally under a concealer and revealed during play; and a remote device to determine whether the at least one code uncovered during play indicates a winning or non-winning area to score the game piece.

50. The system defined in claim 49 wherein the remote device of indicates whether any void area has been uncovered based on comparison of the uncovered portions of the first code to the second code, and indicate that the game piece is void if at least one void area has been uncovered.

51. The system defined in claim 50 wherein the remote device indicates whether any void and win areas have been uncovered based on comparison of the uncovered portions of the first code to the second code, and indicates that the game piece is a winner if no void area been uncovered and at least one win area has been uncovered.

52. The system defined in claim 49 wherein the remote device scans locations on the game piece comprises providing operator feedback that an area being scanned is producing an unidentifiable reading.

53. The system defined in claim 49 wherein the remote device calculates an outcome of the game piece based on presence of any uncovered win and void areas.

* * * * *